US007872551B2

(12) United States Patent
Nakamura et al.

(10) Patent No.: US 7,872,551 B2
(45) Date of Patent: Jan. 18, 2011

(54) RELAY

(75) Inventors: Masanori Nakamura, Kyoto (JP); Yojiro Saruwatari, Kyoto (JP); Tatsuo Shinoura, Kyoto (JP); Akira Ota, Kyoto (JP)

(73) Assignee: OMRON Corporation, Kyoto-shi, Kyoto (JP)

( * ) Notice: Subject to any disclaimer, the term of this patent is extended or adjusted under 35 U.S.C. 154(b) by 319 days.

(21) Appl. No.: 12/063,647

(22) PCT Filed: Aug. 8, 2006

(86) PCT No.: PCT/JP2006/315665

§ 371 (c)(1),
(2), (4) Date: Jun. 10, 2008

(87) PCT Pub. No.: WO2007/020836

PCT Pub. Date: Feb. 22, 2007

(65) Prior Publication Data

US 2009/0261928 A1 Oct. 22, 2009

(30) Foreign Application Priority Data

Aug. 12, 2005 (JP) ..... 2005-234654

(51) Int. Cl.
*H01H 53/00* (2006.01)
*H01H 67/02* (2006.01)
*H01H 3/00* (2006.01)

(52) U.S. Cl. ..... 335/4; 335/5; 335/128; 335/185; 335/189; 335/192; 335/195; 335/202; 200/16 R

(58) Field of Classification Search ..... 335/4, 335/5, 83, 105, 124, 128, 133, 151, 156, 335/185, 189, 190, 192, 195, 196, 199, 202, 335/205; 200/16 R, 51.04, 504; 333/103–109
See application file for complete search history.

(56) References Cited

U.S. PATENT DOCUMENTS 2,498,907 A * 2/1950 Atwood et al. ..... 335/5

(Continued)

FOREIGN PATENT DOCUMENTS

CN 1366693 8/2002

(Continued)

OTHER PUBLICATIONS

International Search Report (English & Japanese) for PCT/JP2006/315665 mailed Sep. 19, 2006 (3 pages).

(Continued)

*Primary Examiner*—Elvin G Enad
*Assistant Examiner*—Mohamad A Musleh
(74) *Attorney, Agent, or Firm*—Osha Liang LLP

(57) ABSTRACT

A relay includes a contact point block having a support shaft with both ends spanning a contact point base, a plunger having a movable contact at a lower end thereof, and a movable iron piece configured to drive the plunger and to have a plate spring. The relay also includes an electromagnetic unit and a base block having a fixed contact point at a position opposite to the movable contact point. The movable iron piece is supported on the supporting shaft. The plunger is inserted through an operation hole of the contact point base. Upper and lower surfaces of the contact point block are held by the electromagnetic unit and the base block. The electromagnetic unit directly fixes the iron core to an upper surface of the contact point base.

4 Claims, 22 Drawing Sheets

U.S. PATENT DOCUMENTS

| | | | | | |
|---|---|---|---|---|---|
| 3,600,542 | A | * | 8/1971 | Richter | 200/288 |
| 4,496,806 | A | * | 1/1985 | Maenishi et al. | 200/16 R |
| 4,496,919 | A | * | 1/1985 | Fournier et al. | 335/5 |
| 5,047,740 | A | * | 9/1991 | Alman | 335/4 |
| 5,063,364 | A | * | 11/1991 | Tsoi | 333/107 |
| 6,037,849 | A | * | 3/2000 | Ciezarek | 335/4 |
| 6,124,771 | A | * | 9/2000 | Kim et al. | 335/4 |
| 6,133,812 | A | * | 10/2000 | Magda | 335/4 |
| 6,204,740 | B1 | * | 3/2001 | Nakahata | 335/4 |
| 6,211,756 | B1 | * | 4/2001 | Sun et al. | 335/4 |
| 6,340,923 | B1 | * | 1/2002 | Yamanaka et al. | 335/4 |
| 7,307,499 | B2 | * | 12/2007 | Nakamura et al. | 335/78 |

FOREIGN PATENT DOCUMENTS

| | | | |
|---|---|---|---|
| EP | 0111640 | A2 | 6/1984 |
| EP | 1047089 | A2 | 10/2000 |
| FR | 2563945 | A1 | 11/1985 |
| JP | 7-147122 | | 6/1995 |
| JP | 2000-306481 | | 11/2000 |
| JP | 2002-133988 | | 5/2002 |
| JP | 2003-257734 | | 9/2003 |

OTHER PUBLICATIONS

Patent Abstracts of Japan 2003-257734 dated Sep. 12, 2003 (1 page).
Patent Abstracts of Japan 07-147122 dated Jun. 6, 1995 (1 page).
Patent Abstracts of Japan 2002-133988 dated May 10, 2002 (1 page).
Patent Abstracts of Japan 2000-306481 dated Nov. 2, 2000 (1 page).
Extended European Search Report for Application No. 06782491.2, mailed on Feb. 13, 2009 (8 pages).
International Preliminary Report on Patentability from PCT/JP2006/315665 dated Feb. 21, 2008 (2 pages).
English Translation of International Preliminary Report on Patentability from PCT/JP2006/315665 dated Feb. 21, 2008 (2 pages).
English Translation of Written Opinion of the International Searching Authority from PCT/JP2006/315665 dated Feb. 21, 2008 (3 pages).
Chinese Office Action for Chinese Application No. 200680037235.1, mailed on May 25, 2010 (9 pages).
esp@cenet patent abstract for Chinese Publication No. 136693, Publication Date Aug. 28, 2002 (1 page).

* cited by examiner

RELAY

FIELD OF INVENTION

The present invention relates to a relay, in particular, to a high-frequency relay used for broadcast equipment and measurement equipment.

BACKGROUND

In a high-frequency relay, for example, there is a coaxial relay as shown in FIGS. 3 and 8, in which a frame 27 welded to side surfaces of a sub-base 4 is formed with ribs 43 by means of press work, the ribs 43 are loosely fitted into square openings 42 of an armature spring 19 which is integrated with an armature 2, an upper surface of the armature spring 19 is brought into contact with a dowel 49 protrusively provided on a lower surface of a protruding piece 48 of the frame 27 so as to be freely rotatable, and drivers (plungers) 16 whose lower portions are integrated with contacts 5 are supported on the sub-base 4 in a manner so as to be movable up and down, and both end portions of the armature 2 alternately drive the plungers 16 as shown in FIG. 1 and FIG. 2 (see Patent Document 1).

That is, while the drivers and the contacts are directly positioned to the sub-base in the above coaxial relay, the armature is positioned to the drivers so as to be able to come in contact with the drivers through the frame assembled to the sub-base.

Patent Document 1: JP2000-306481A

However, since the armature is positioned to the drivers through the frame, there is a limitation in that the armature is assembled to the sub-base with high assembling accuracy. In particular, since the frame has a complicated shape and is required to be manufactured by means of press work, it is difficult to secure high component accuracy and assembling accuracy. As a result, a problem arises that operation characteristics of a relay are varied.

In view of the above problem, an object of the present invention is to provide a relay which has high assembling accuracy and shows reduced variations in operation characteristics.

BRIEF SUMMARY OF THE INVENTION

In order to solve the above problem, in a relay according to the present invention, a plunger is driven with a movable iron piece, which is alternately attracted to and separated from an iron core of an electromagnetic unit based on excitation and nonexcitation of the electromagnetic unit, and a movable contact point provided at a lower end portion of the plunger is contacted with and separated from a fixed contact point, a contact point block is constructed of a supporting shaft with its both ends spanning a contact point base, a movable iron piece to a lower surface of which a plate spring is fixed and which is supported on the supporting shaft so as to be rotatable, and a plunger which is inserted through an operation hole of the contact point base so as to be movable up and down and whose lower end portion protruding from a lower surface of the contact point base is provided with a movable contact point, and an upper and lower surfaces of the contact point block are held by the electromagnetic unit that directly fixes the iron core to an upper surface of the contact point base and the base block in which the fixed contact point is placed at a position opposite to the movable contact point so as to be able to be contacted with and separated from the movable contact point.

According to the present invention, the upper and lower surfaces of the contact point block, to which the movable iron piece and the plunger are assembled, are assembled by holding the electromagnetic unit that directly fixes the iron core to the upper surface of the contact point base and the base block in which the fixed contact point is placed at the position opposite to the movable contact point so as to be able to be contacted with and separated from the movable contact point. Therefore, the movable iron piece and the plunger can be assembled with high positioning accuracy, and the electromagnetic unit can be assembled with high positioning accuracy by directly fixing the iron core to the upper surface of the contact point base. As a result, the components that are important for maintenance and improvement of operation characteristics can be assembled with high positioning accuracy, so that a relay which does not cause variations in operation characteristics is obtained.

In an embodiment of the present invention, the contact point base may be provided with at least one adjustment opening, which enables an adjustment of the plate spring of the movable iron piece rotatably supported on the contact point base from a lateral side.

According to the present embodiment, since the plate spring can be adjusted from the adjustment opening, it is not required to take apart an intermediate product during assembling, so that assembling workability is improved and a manufacturing yield can be improved.

In another embodiment of the present invention, a magnetic shielding sheet may be held by the base block and the contact point block.

According to the present embodiment, since shielding can be achieved with the magnetic shielding sheet, a relay having excellent high-frequency characteristics is obtained.

DETAILED DESCRIPTION

Description of the Numerals

Figure 1:
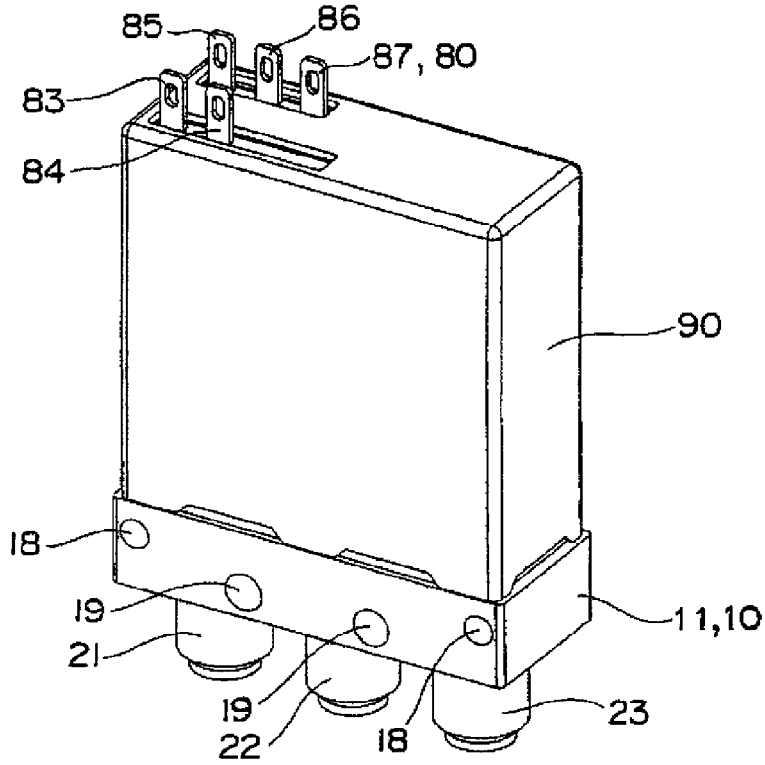
FIG. 1 is a perspective view of a coaxial relay showing an embodiment according to the present invention.

10: contact point unit
11: base block
12: escape groove
13, 14, 15: through holes for coaxial connectors
16*a*, 16*b*: positioning pins
18, 19: attachment through holes
21, 22, 23: coaxial connectors
21*a*, 22*a*, 23*a*: fixed contact points
24: copper sheet
30: contact point block
31: contact point base
31*a*, 31*b*: operation holes
32, 33, 34, 35: supporting posts
36, 37: supporting walls
36*a*, 36*b*, 36*c*, 37*a*, 37*b*, 37*c*: positioning projections
36*d*, 37*d*: position restricting protrusions
36*e*, 37*e*: shaft holes
41, 42: coil springs
43, 44: plungers
45, 46: movable contact points
45*a*, 46*a*: caulk openings
45*b*: engagement recess
50: movable iron piece
53: plate spring
55: bearing portion
55*a*: shaft hole
56, 57: elastic arm portions
58: supporting shaft
60: electromagnetic unit
61, 65: self-resetting type first, second spools
61*a*, 65*a*: body portions
61*b*, 65*b*: through holes
62, 63, 66, 67: flange portions
62*a*, 66*a*: positioning tongues
64, 68: positioning walls
69: self-holding spool
71, 73: coils
72*a*, 72*b*, 74*a*, 74*b*: coil terminals
75: yoke
75*a*, 75*b*: arm portions
76, 77: first, second iron cores
76*a*, 77*a*: vertical portions
79: permanent magnet
80: control unit
81: printed circuit board
82: terminal stand
83-87: input/output terminals
88: electronic component
90: cover
91, 92: elongate openings A coaxial relay that is an embodiment to which the present invention has been applied will be described with reference to the accompanying drawings of FIG. 1 to FIG. 23.

The coaxial relay of the present embodiment is generally constructed of a contact point unit 10, a movable iron piece 50, an electromagnetic unit 60, a control unit 80 and a cover 90.

Figure 6:
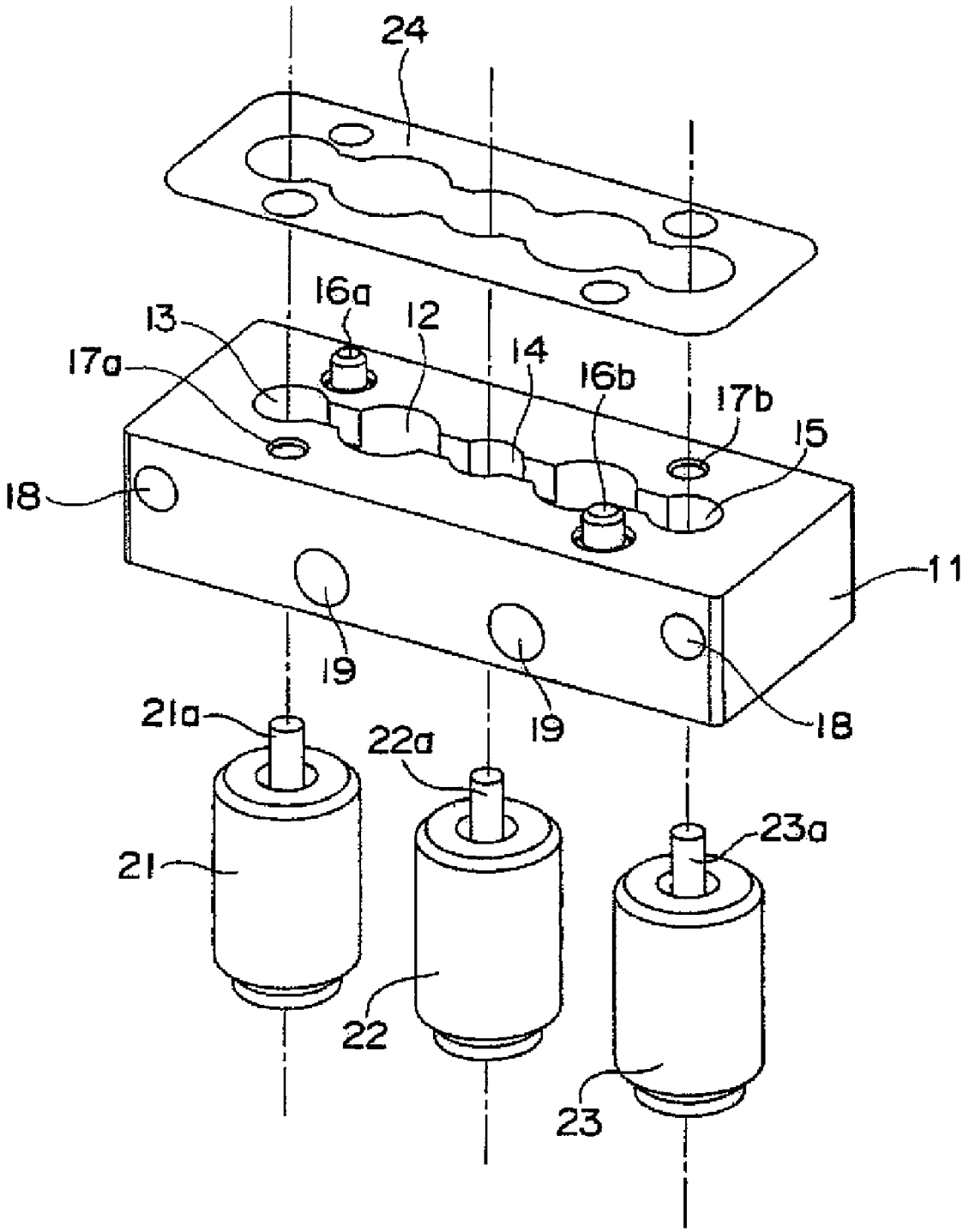
FIG. 6 is a partially enlarged perspective view of the perspective view shown in FIG. 5.

The contact point unit 10 is constructed of a base block 11, a copper sheet 24 and a contact point block 30. As shown in FIG. 6, the base block 11 is a rectangular parallelepiped, and an escape groove 12 is formed in a central portion of an upper surface of the base block 11. A pair of positioning pins 16*a*, 16*b* are protrusively provided so as to be point symmetrical with each other, and a pair of screw holes 17*a*, 17*b* are formed so as to be point symmetrical with each other around the escape groove 12 of the base block 11. However, the positioning pins 16*a*, 16*b* and the screw holes 17*a*, 17*b* are not disposed in positions that are line symmetrical with each other in order to determine the assembling direction of the contact point block 30. Through holes 13, 14, 15 for coaxial connectors are formed in the escape groove 12 at an equal pitch. An inner peripheral surface on a bottom surface side of each of the through holes 13, 14, 15 is provided with a female screw portion for a coaxial connector. Therefore, coaxial connectors 21, 22, 23 are screwed and fixed to the through holes 13, 14, 15, whereby fixed contact points 21*a*, 22*a*, 23*a* protruding respectively from tips of the coaxial connectors 21, 22, 23 are positioned in the escape groove 12. Further, attachment through holes 18, 19 for fixing the base block 11 itself to another place are provided in side surfaces of the base block 11.

Figure 7:
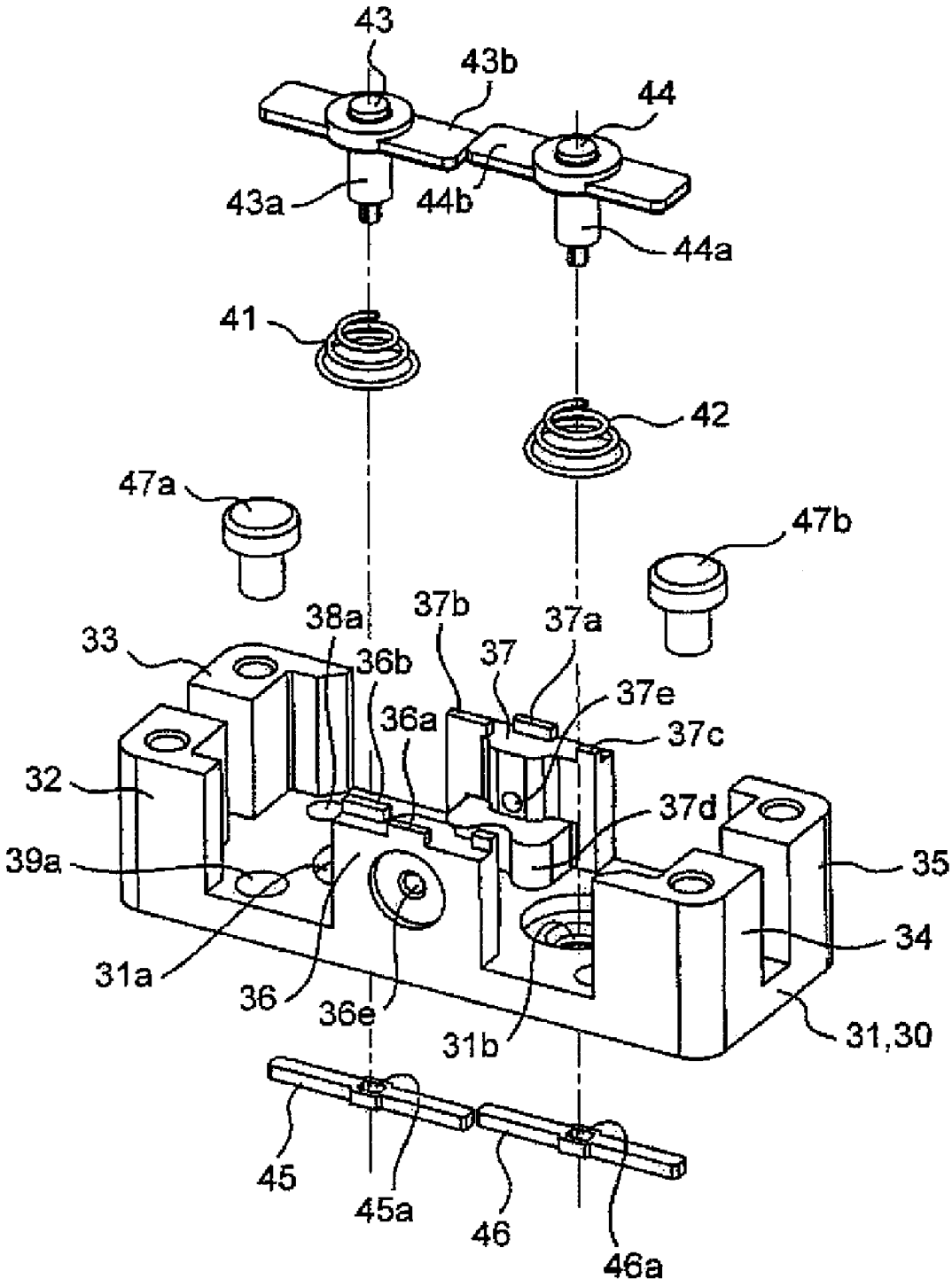
FIG. 7 is a partially enlarged perspective view different from the perspective view shown in FIG. 5.

In a contact point block 30, a central portion of an upper surface of a contact point base 31 is provided with a pair of operation holes 31*a*, 31*b* as shown in FIG. 7. Upper opening edge portions of the operation holes 31*a*, 31*b* are provided with annular step portions for positioning coil springs 41, 42, respectively, described below. Further, as shown in FIG. 8, in proximity of the operation holes 31*a*, 31*b*, positioning holes 38*a*, 38*b* are provided, and fixing holes 39*a*, 39*b* are provided. Further, supporting posts 32, 33, 34, 35 are protrusively provided at corner portions of the upper surface of the contact point base 31. A supporting wall 36 is protrusively provided between the supporting posts 32 and 34, and a supporting wall 37 is protrusively provided between the supporting posts 33 and 35. Upper end surfaces of the supporting walls 36, 37 are respectively protrusively provided with positioning projections 36*a*, 36*b*, 36*c* and 37*a*, 37*b*, 37*c*. Further, position restricting protrusions 36*d*, 37*d* are provided at basal portions of opposite surfaces of the supporting walls 36, 37. Moreover, shaft holes 36*e*, 37*e*, which are located on the same horizontal shaft center, are provided in the supporting walls 36, 37. Of an outer surface of the supporting wall 36, an opening edge portion of the shaft hole 36*e* is provided with an annular step portion, which serves as a mark in assembling as well as is used for securing a pushing margin.

Generally truncated conical shaped coil springs 41, 42, which are positioned with respect to the annular step portions of the operation holes 31*a*, 31*b*, respectively, and plungers 43, 44, whose cross sections are generally T-shaped, and whose shaft portions 43*a*, 44*a* are inserted into the centers of the coil springs 41, 42, respectively, are assembled to the contact point base 31. Lower end portions of the plungers 43, 44, which protrude from the operation holes 31*a*, 31*b*, are fitted into caulk openings 45*a*, 46*a*, which have a generally rectangular shape in plan view, of movable contact points 45, 45, respectively, and fixed by caulking. Thereby, the plungers 43, 44 are urged upward and supported on the contact point base 31 so as to be movable up and down.

As shown in FIG. 22, for example, an engagement recess 45*b*, which is formed in a lower opening edge portion of the caulk opening 45*a* of the movable contact point 45, may be formed in a straight line shape (FIGS. 22A-22C) or a cross shape (FIGS. 22D-22F) by press work. The reason therefor is that, by engaging a resin solidified by thermal caulking, free rotation of the movable contact point 45 is prevented.

Figure 23A:
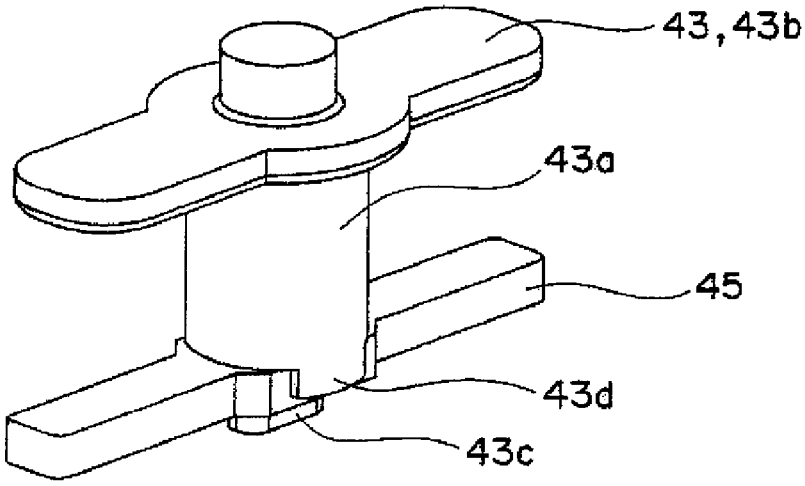
FIG. 23A and FIG. 23B are perspective views and FIG. 23C is a bottom view, which are provided for describing another method for attaching the movable contact point to a plunger.
Figure 23B:
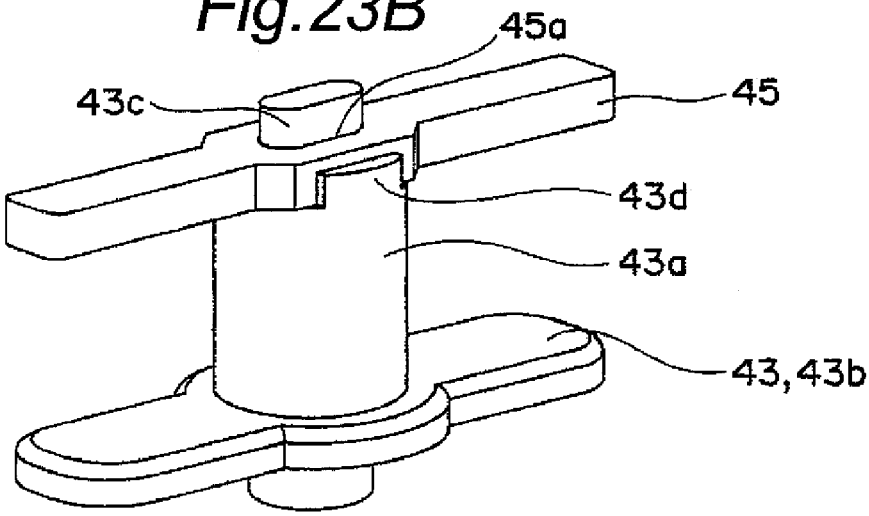
Figure 23C:
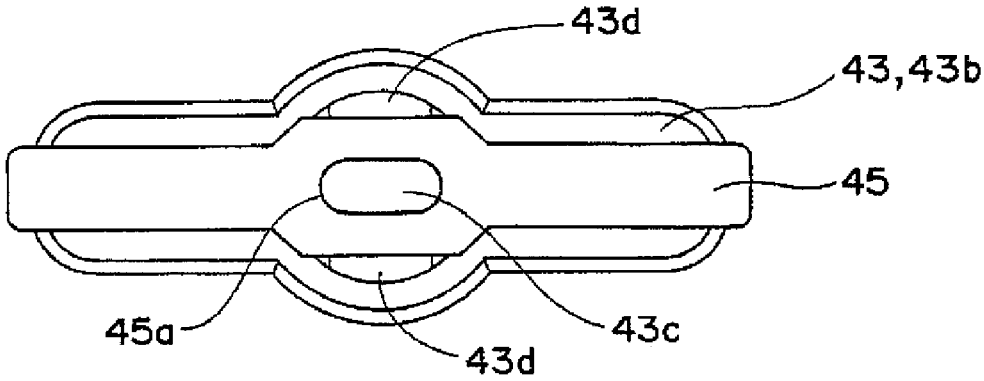

Further, as shown in FIG. 23, for example, a tip end face of the shaft portion 43*a* of the plunger 43 is protrusively provided with a tip end portion 43*c* having an elliptical shape in cross section, and a pair of engagement claws 43*d*, 43*d* are protrusively provided on both sides of the tip end portion 43*c*. Then, the caulk opening 45*a* of the movable contact point 45 is fitted over the tip end portion 43*c*, and thermal caulking is performed to fix the movable contact point 45, whereby free rotation of the movable contact point 45 may be prevented. Furthermore, the movable contact points 45, 46 may be fixed to the plungers 43, 44 by an adhesive or insert molding.

Figure 9A:
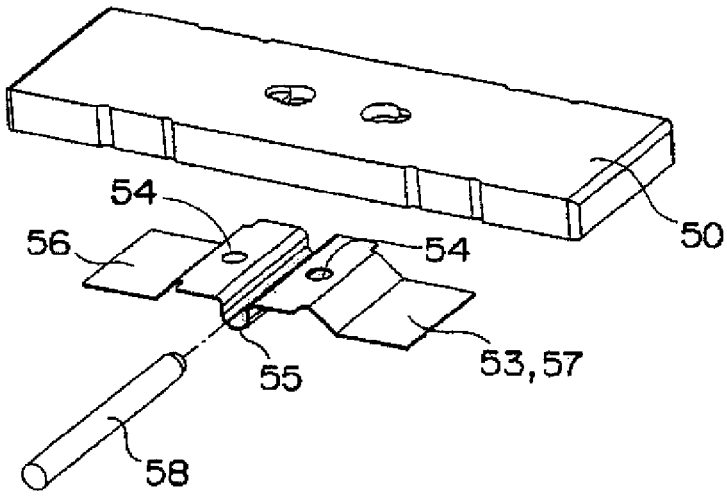
FIG. 9A, FIG. 9B and FIG. 9C are a perspective view, an elevational view and a bottom view, respectively, of a movable iron piece.
Figure 9B:
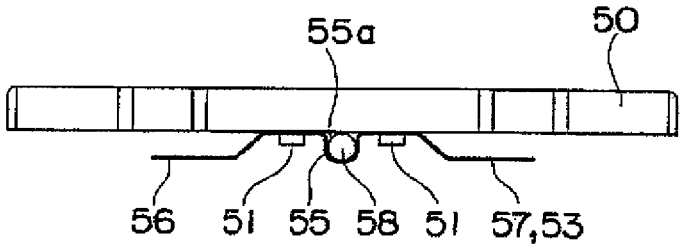
Figure 9C:
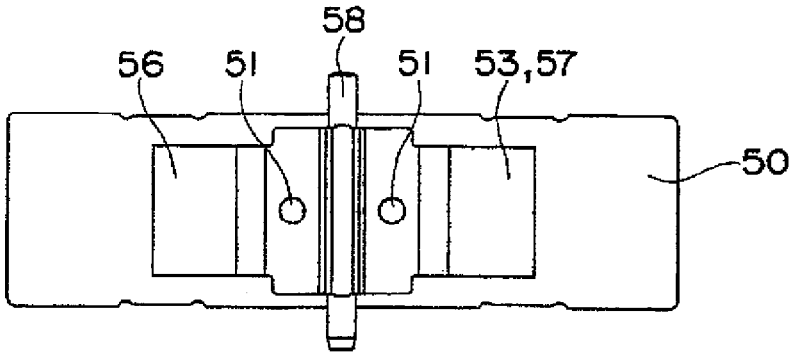

As shown in FIG. 9, the movable iron piece 50 is a plate material having a generally rectangular shape in plan view, and caulk openings 54 of a plate spring 53 subjected to bending work are fitted over a pair of projections 51, 51 protrusively provided on a central portion of a lower surface of the movable iron piece 50, and then fixed by caulking, whereby a shaft hole 55*a* is formed by one surface of the movable iron piece 50 and a bearing portion 55. The plate spring 53 is formed symmetrically, with the bearing portion 55 supporting a supporting shaft 58 as the center. Therefore, the movable iron piece 50, to which the plate spring 53 has been caulk-fixed, is positioned between the supporting walls 36, 37, and the supporting shaft 58 is inserted into the shaft holes 36*e*, 37*e* of the contact point block 30 and the shaft hole 55*a* formed by the movable iron piece 50 and the plate spring 53, whereby the movable iron piece 50 is supported so as to be freely rotatable. As a result, it becomes possible for flexible arm portions 56, 57 of the plate spring 53 to alternately come in contact with the first and second plungers 43, 44 of the contact point block 30.

According to the present embodiment, a circular arc surface of the bearing portion 55 that forms the shaft hole 55*a* has a larger radius than that of the supporting shaft 58. Therefore, the supporting shaft 58 is brought into line contact with the bearing portion 55 of the plate spring 53, resulting in small friction. Thus, a relay having excellent operation characteristics is obtained. In addition, the shape of the bearing portion 55 of the plate spring 53 is not limited to the arc shape in cross section. The supporting shaft 58 may be brought into line contact with the bearing portion 55 by forming the circular arc surface of the bearing portion 55 in a triangular shape in cross section or a square shape in cross section, for example.

The electromagnetic unit 60 is constructed of a self-resetting first and second spools 61, 65 around which coils 51, 71 are wound, respectively, a yoke 75, a first and second iron cores 76, 77 and a permanent magnet 79.

Figure 10E:
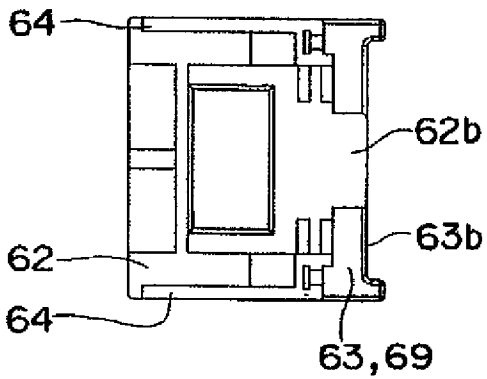
FIG. 10E and FIG. 10F are a plan view and an elevational view, respectively, which show a self-holding spool.
Figure 10F:
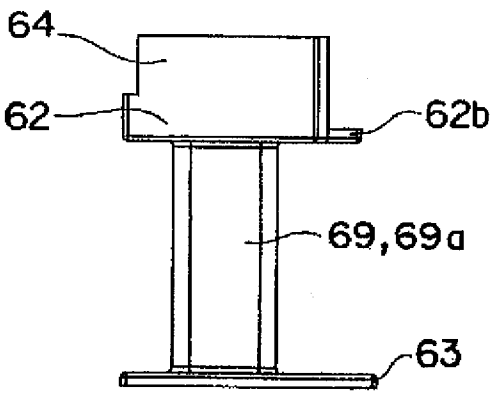
Figure 10C:
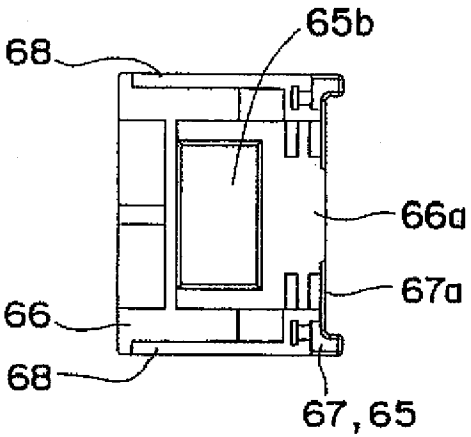
FIG. 10C and FIG. 10D are a plan view and an elevational view, respectively, which show a self-resetting second spool.
Figure 10D:
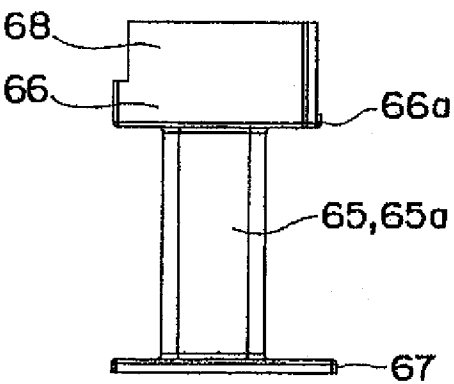
Figure 10A:
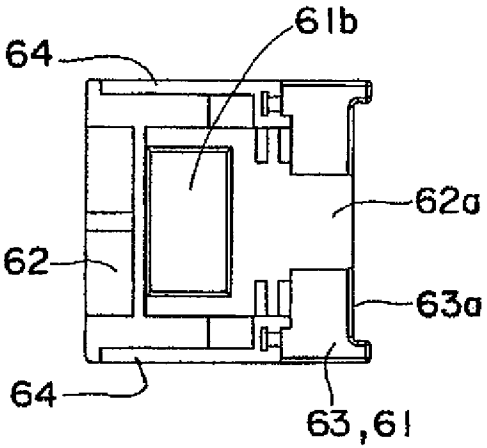
FIG. 10A and FIG. 10B are a plan view and an elevational view, respectively, which show a self-resetting first spool.
Figure 10B:
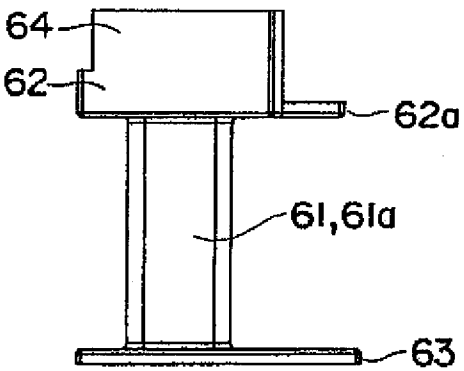
Figure 14A:
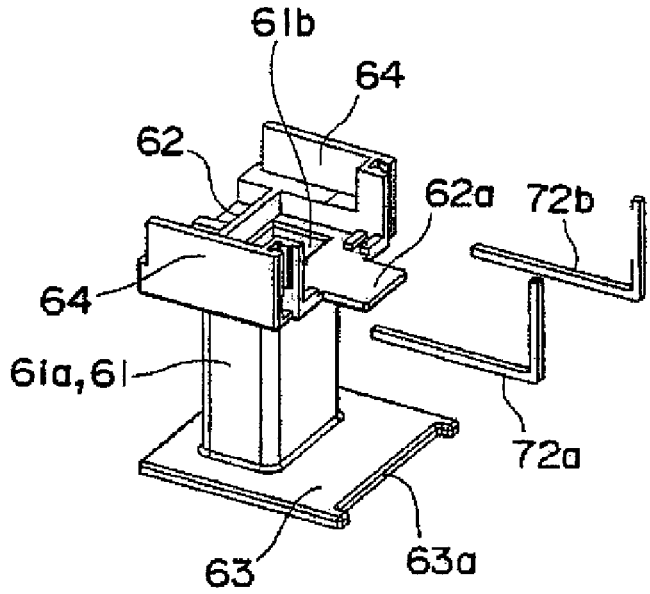
FIG. 14A and FIG. 14B are perspective views for describing an assembling method of a first spool and that of a second spool, respectively.

As shown in FIGS. 10A, 10B and FIG. 14A, of flange portions 62, 63 integrally formed on both ends of a cylindrical body portion 61*a* of the self-resetting first spool 61, a leader line of a coil 71 wound on the body portion 61*a* is tied and soldered to horizontal end portions of a pair of generally L-shaped coil terminals 72*a*, 72*b*, which are inserted into one flange portion 62. Further, a positioning tongue 62*a* for holding a permanent magnet 79 protrudes laterally from an inward side edge portion of the flange portion 62, and positioning walls 64, 64 respectively protrude upward from both side edge portions of an upper surface of the flange portion 62. Furthermore, an inward side edge portion of the flange portion 63 is provided with a notch portion 63*a* for positioning the permanent magnet 79.

Figure 14B:
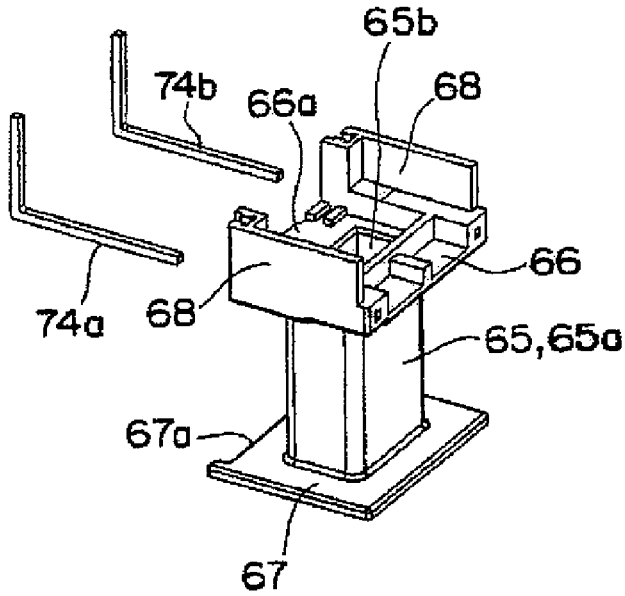

As shown in FIGS. 10C, 10D and FIG. 14B, of flange portions 66, 67 integrally formed on both ends of a cylindrical body portion 65*a* of the self-resetting second spool 65, a leader line of a coil 73 wound on the body portion 65*a* is tied and soldered to horizontal end portions of a pair of generally L-shaped coil terminals 74*a*, 74*b*, which are inserted into one flange portion 66. Further, a positioning tongue 66*a* for holding the permanent magnet 79 protrudes laterally from an inward side edge portion of the flange portion 66, and positioning walls 68, 68 respectively protrude upward from both side edge portions of an upper surface of the flange portion 66. Furthermore, an inward side edge portion of the flange portion 67 is provided with a notch portion 67*a* for positioning the permanent magnet 79.

The reason why the flange portions 62, 66 of the first and second spools 61, 65 are not configured to be symmetrical is that the permanent magnet 79, which will be described below, is not supported at the center but at an eccentric position whereby a magnetic balance is disturbed to construct a self-resetting type relay.

If a self-holding type relay is constructed, for example, a coil may be wound on a body portion 69*a* of a self-holding spool 69 as shown in FIGS. 10E, 10F to be used. A positioning tongue 62*b* and a notch portion 63*b* of the spool 69 have an outer shape for supporting the permanent magnet 79 at the center.

A yoke 75 has a generally U-shape in cross section, and its both side arm portions 75*a*, 75*b* are press-fitted into the cylindrical bodies 61*a*, 65*a* of the first and second spools 61, 65, respectively, whereby the first spool 61 and the second spool 65 are joined and integrated. The yoke 75 is provided to construct a magnetic circuit together with first and second iron cores 76, 77 described below.

Figure 13:
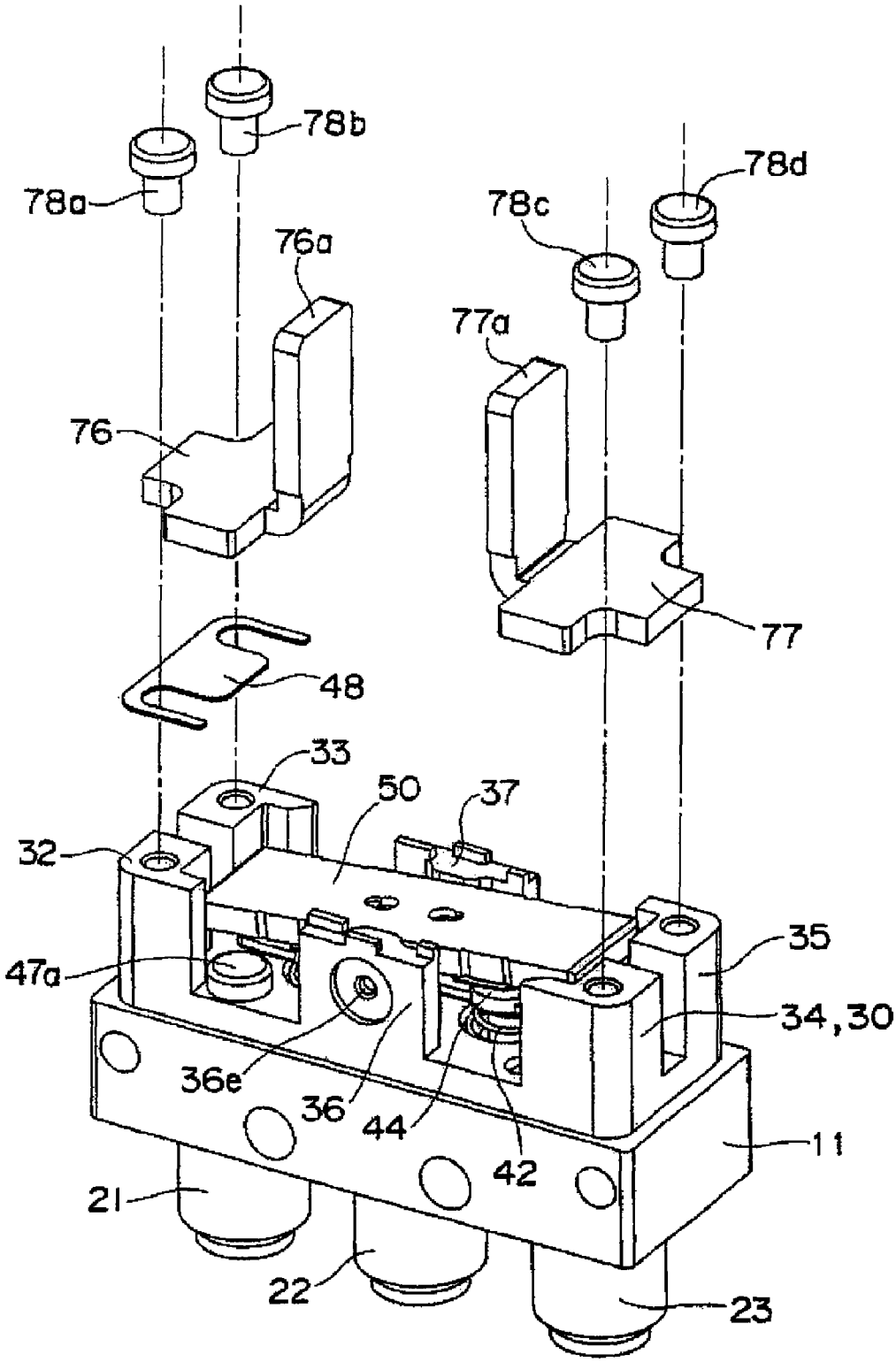
FIG. 13 is a perspective view for describing a method for attaching a first and second iron cores to the contact point unit.

As shown in FIG. 13, the first and second iron cores 76, 77 have a generally L-shape in cross section, and are directly fixed to upper end surfaces of the supporting posts 32, 33 and 34, 35 of the contact point base 31 with screws 78*a*, 78*b* and 78*c*, 78*d*, respectively. Accordingly, the first and second iron cores 76, 77 are assembled to the contact point base 31 with high assembling accuracy. Vertical portions 76*a*, 77*b* of the first and second iron cores 76, 77 are inserted into through holes 61*b*, 65*b* of the cylindrical body portions 61*a*, 65*b* of the first, second spools 61, 65, respectively, so as to be brought into surface contact with both of the arm portions 75*a*, 75*b*, thus constructing a magnetic circuit.

Figure 19:
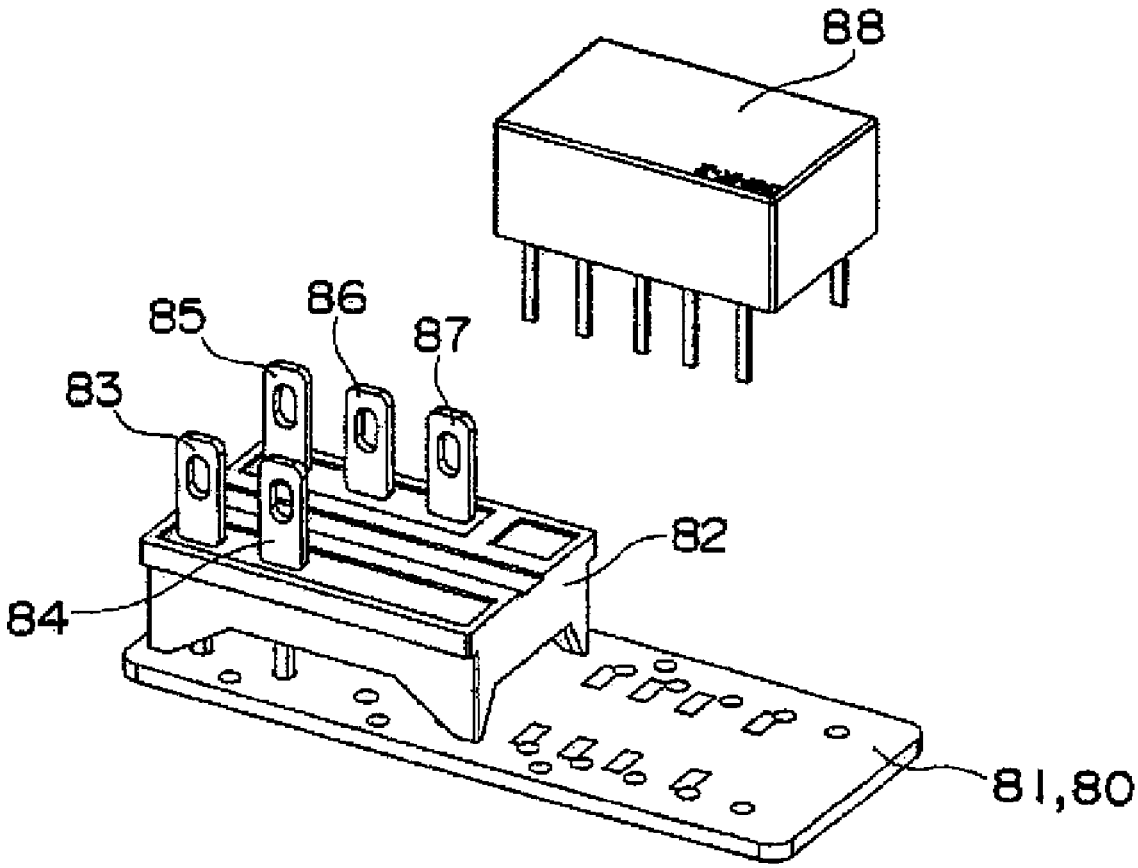
FIG. 19 is a perspective view for describing an method for assembling a terminal stand and an electronic component to a printed circuit board.

As shown in FIG. 19, a control unit 80 is constructed by mounting a terminal stand 82 and an electronic component 88 on a printed circuit board 81.

Figure 18A:
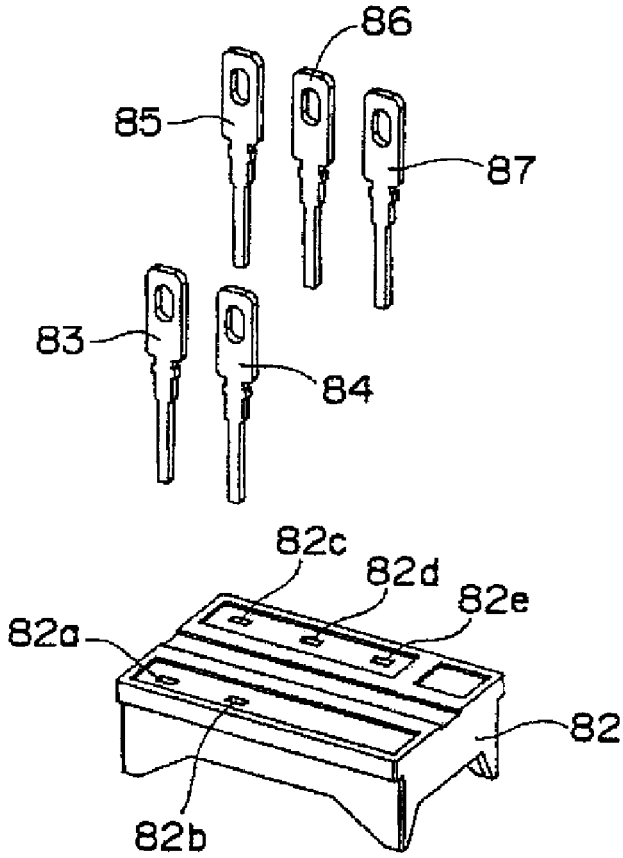
FIG. 18A and FIG. 18B are perspective views for describing an assembling method of a control unit.
Figure 18B:
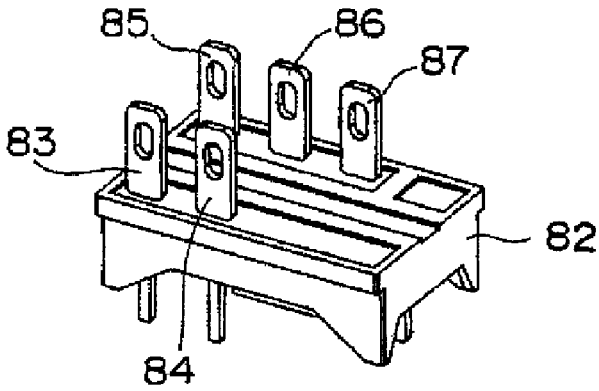
Figure 20:
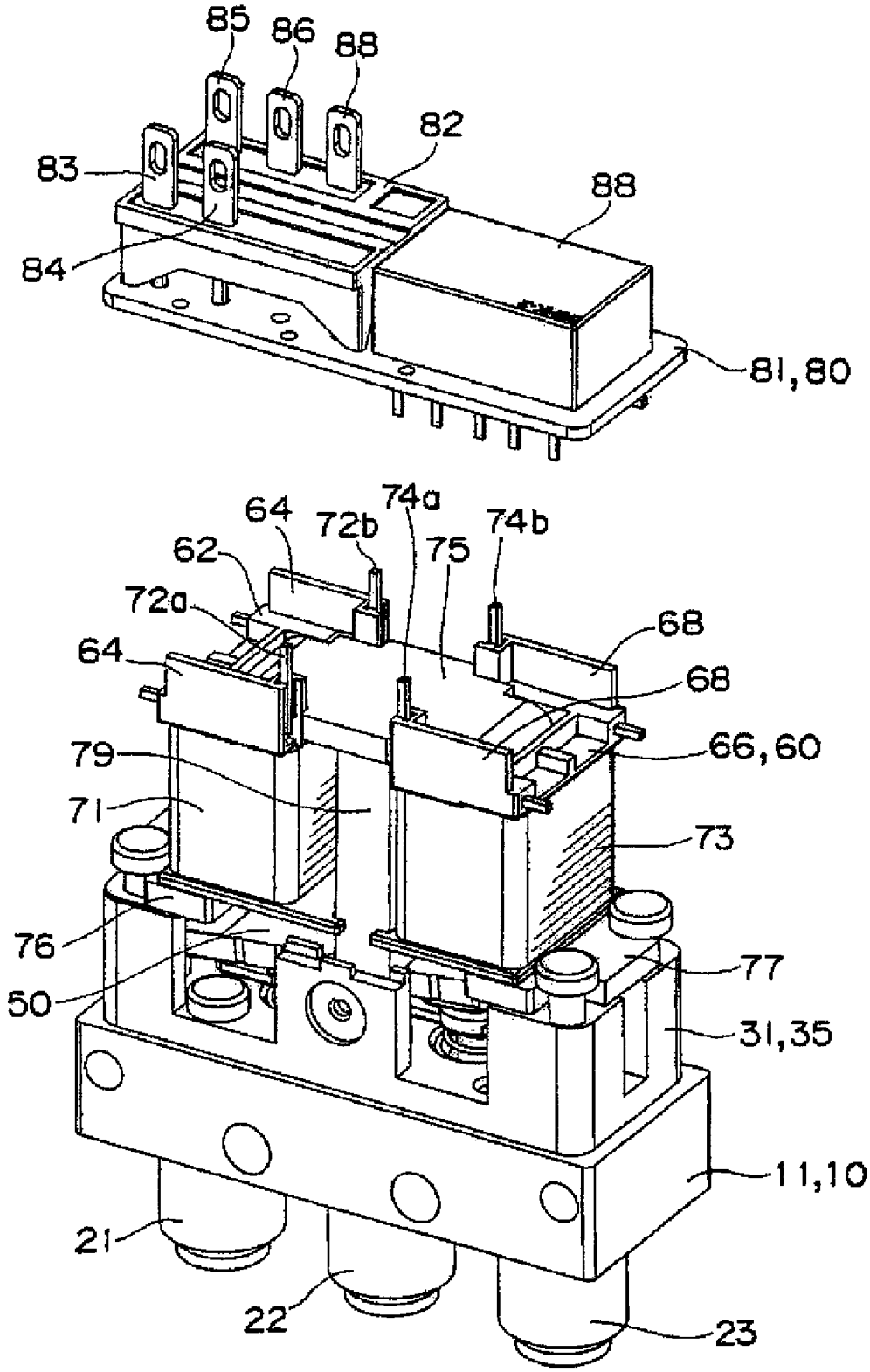
FIG. 20 is a perspective view for describing a method for assembling the control unit to the electromagnetic unit.
Figure 21:
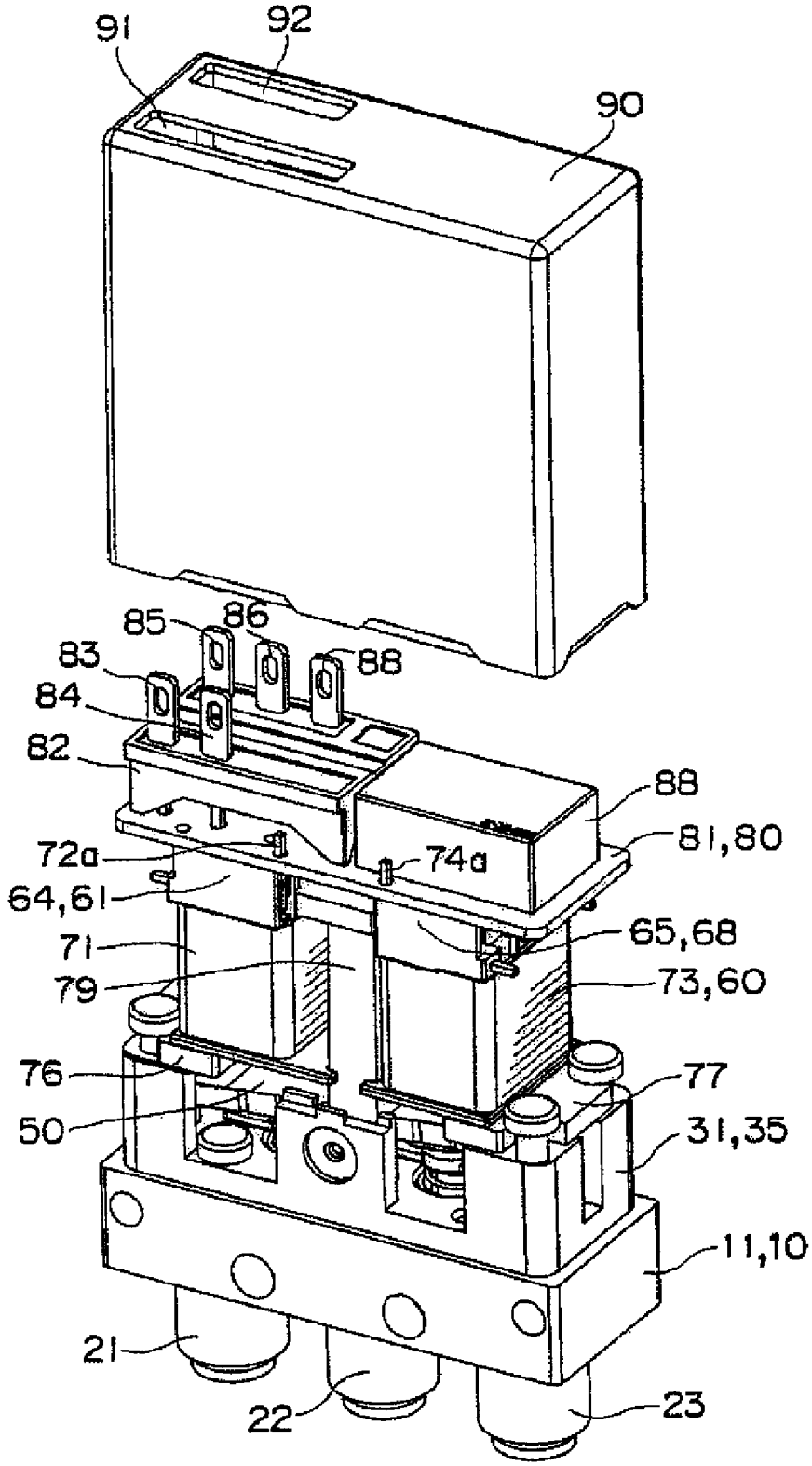
FIG. 21 is a perspective view for describing a method for assembling the cover to the contact point unit and the electromagnetic unit.
Figure 22A:
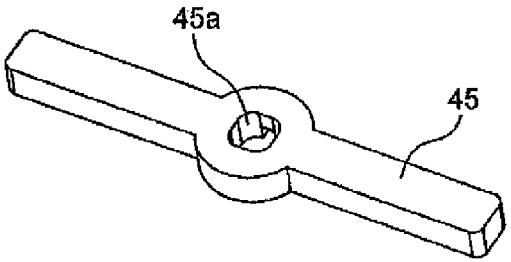
FIG. 22A, FIG. 22B and FIG. 22C are an upper perspective view, a bottom view and a lower perspective view, respectively, which show a case in which an engagement recess is formed in a straight line shape in a caulk opening of a movable contact point.
Figure 22B:
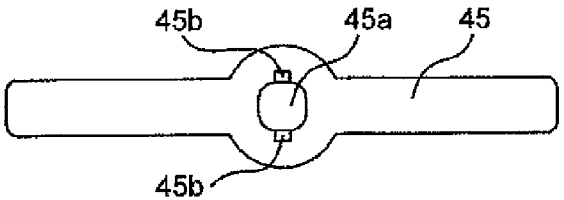
Figure 22C:
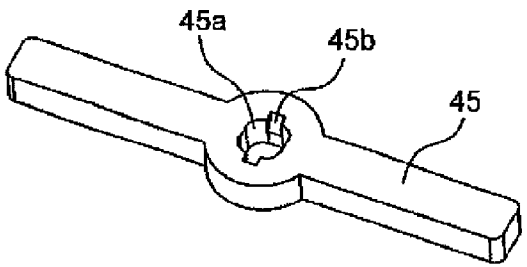
Figure 22D:
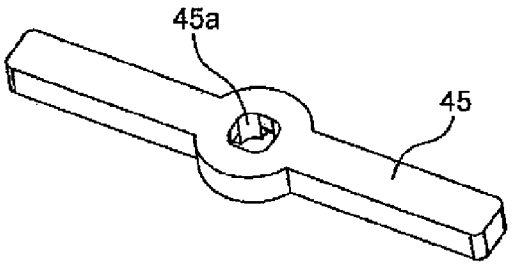
FIG. 22D, FIG. 22E and FIG. 22F are an upper perspective view, a bottom view and a lower perspective view, respectively, which show a case in which an engagement recess is formed in a cross shape in a caulk opening of a movable contact point.
Figure 22E:
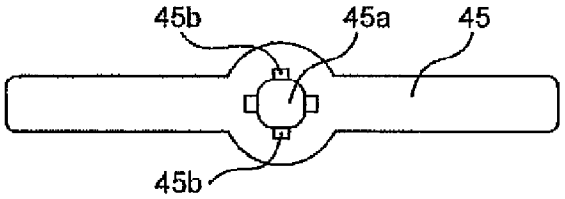
Figure 22F:
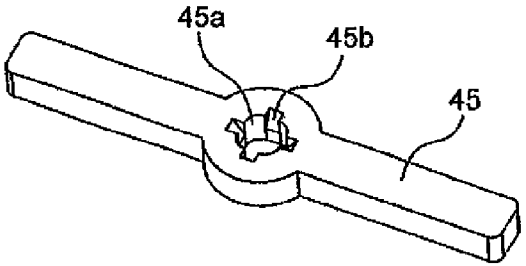

As shown in FIG. 18, input/output terminals 83 to are press-fitted into terminal holes 82*a* to 82*e*, respectively, of the terminal stand 82 from an upper side so as to be protruded to a lower side thereof, and a seal material is injected and solidified to fix the input/output terminals. Terminal portions of the input/output terminals 83 to 88 that protrude from the lower side of the terminal stand 82 are respectively electrically connected to the printed circuit board (FIG. 20).

As the electronic component 88, for example, a small relay for monitor output is given.

A cover 90 has a box shape that can be fitted over the base block 11 of the contact point unit 10 on which the electromagnetic unit 60 is mounted, and two elongate openings 91, 92 for input/output terminals are provided in a ceiling surface thereof.

A method for assembling the above components will be described.

Figure 11:
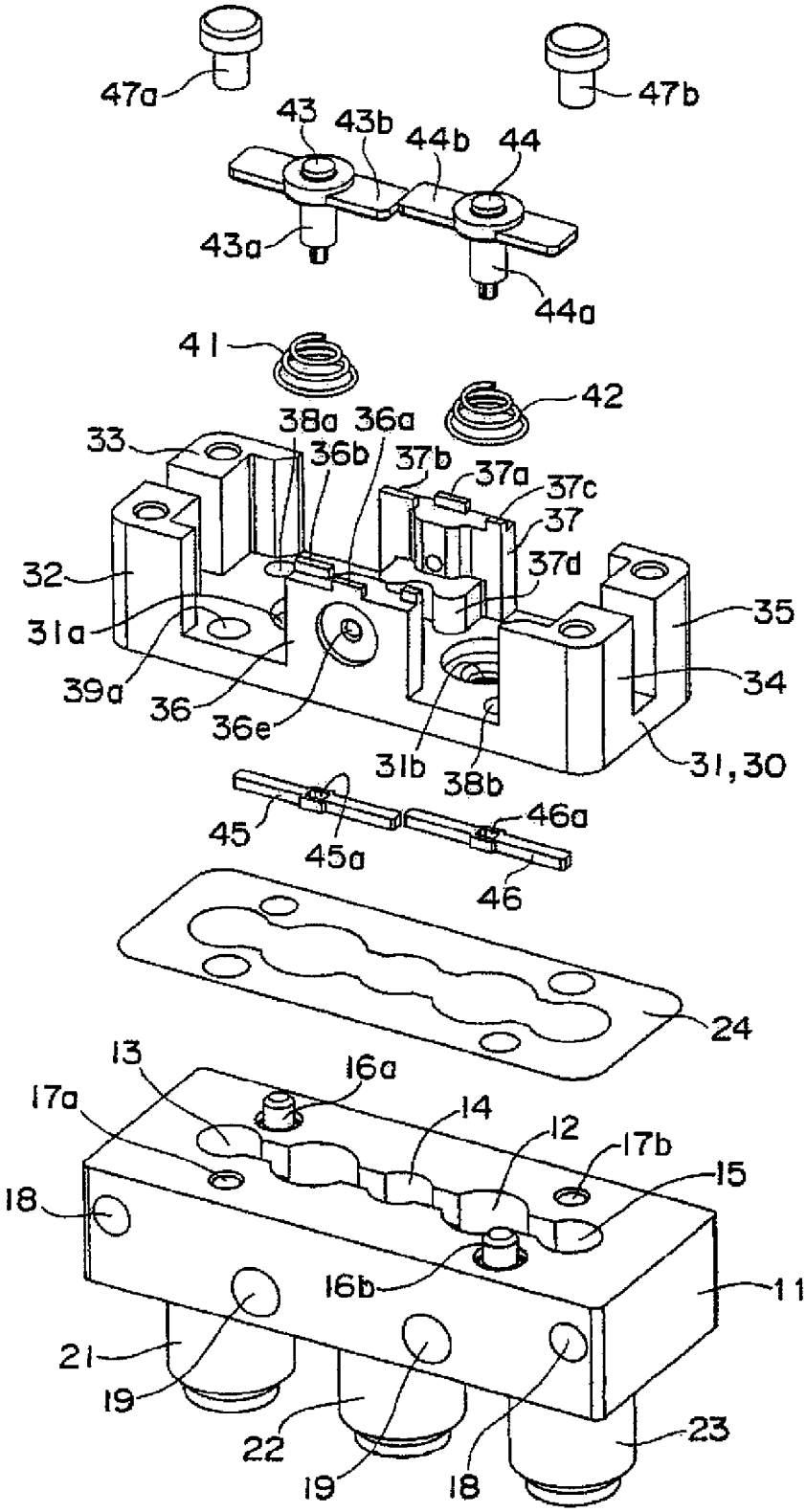
FIG. 11 is a perspective view for describing an assembling method of a contact point unit.

First, as shown in FIG. 11, the coaxial connectors 21, 22, 23 are screwed into the through holes 13, 14, 15, respectively, and integrated therewith.

On the other hand, the coil springs 41, 42 are positioned with respect to the step portions of the operation holes 31*a*, 31*b* provided in the contact point base 31, respectively, and the shaft portions 43*a*, 44*a* of the plungers 43, 44 having the generally T-shape in cross section are inserted therethrough. Then, the protruding lower end portions of the plungers 43, 44 are fitted into the caulk openings 45*a*, 45*b* of the movable contact points 45, 46 and fixed by caulking.

Figure 8A:
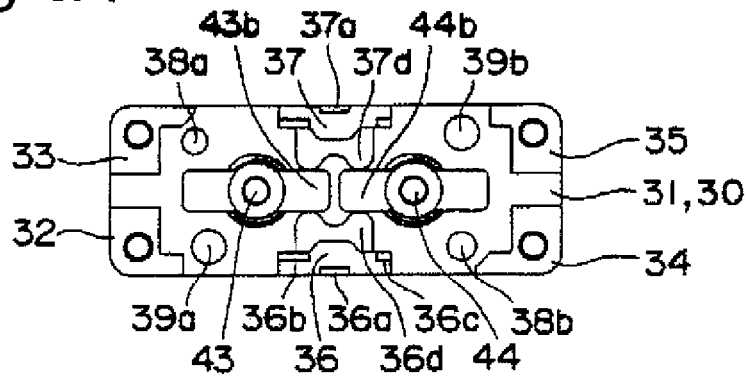
FIG. 8A, FIG. 8B, FIG. 8C and FIG. 8D are a plan view, an elevational view, a bottom view and a perspective view, respectively, of a contact point block 30.
Figure 8B:
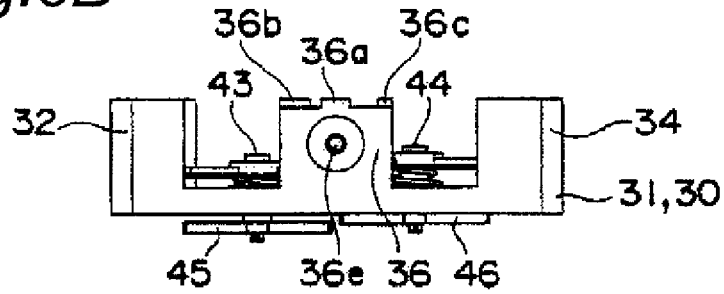
Figure 8C:
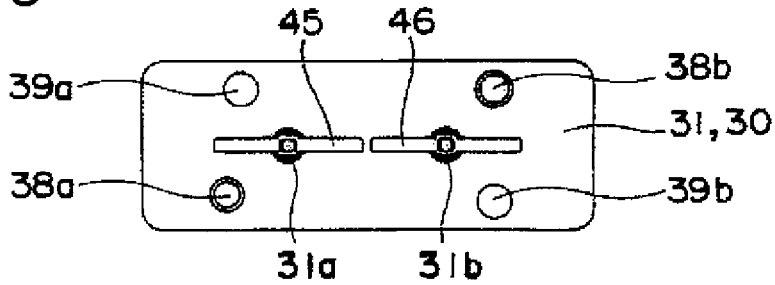
Figure 8D:
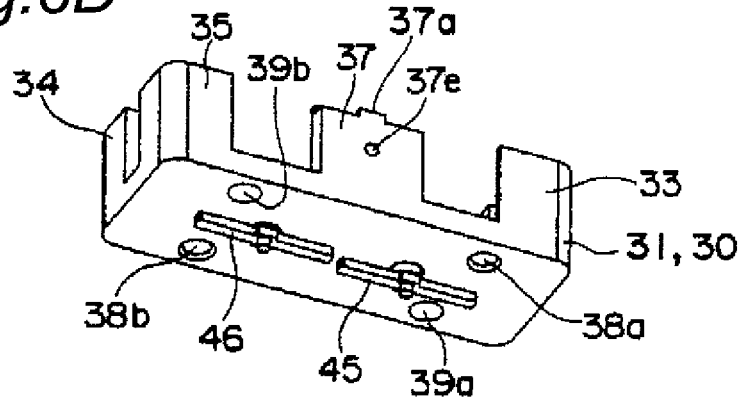

According to the present embodiment, the arm portions 43*b*, 44*b* of the plungers 43, 44 come in contact with the position restricting protrusions 36*d*, 37*d* provided at the basal portions of the opposite surfaces of the supporting walls 36, 37 of the contact point base 31, respectively, so that their positions are restricted (see FIG. 8A). Thus, the movable contact points 44, 45 are accurately brought into contact with the fixed contact points 21*a*, 22*a*, 23*a* without rotation of the plungers 43, 44, and the movable contact points 44, 45. Therefore, there is an advantage that contact reliability is high. In addition, the position restricting means for the plungers 43, 44 may be protrusively provided at other portions of the contact point base 31.

Subsequently, the positioning holes 38*a*, 38*b* of the contact point base 31 are fitted over the positioning pins 16*a*, 16*b* of the base block 11 so as to hold the copper sheet 24. The copper sheet 24 performs magnetic shielding, so that high-frequency characteristics can be improved. Then, screws 47*a*, 47*b* are screwed into the screw holes 17*a*, 17*b* of the base block 11 from the fixing holes 39*a*, 39*b* of the contact point base 31, respectively, whereby the contact point unit 10 is completed.

Figure 12:
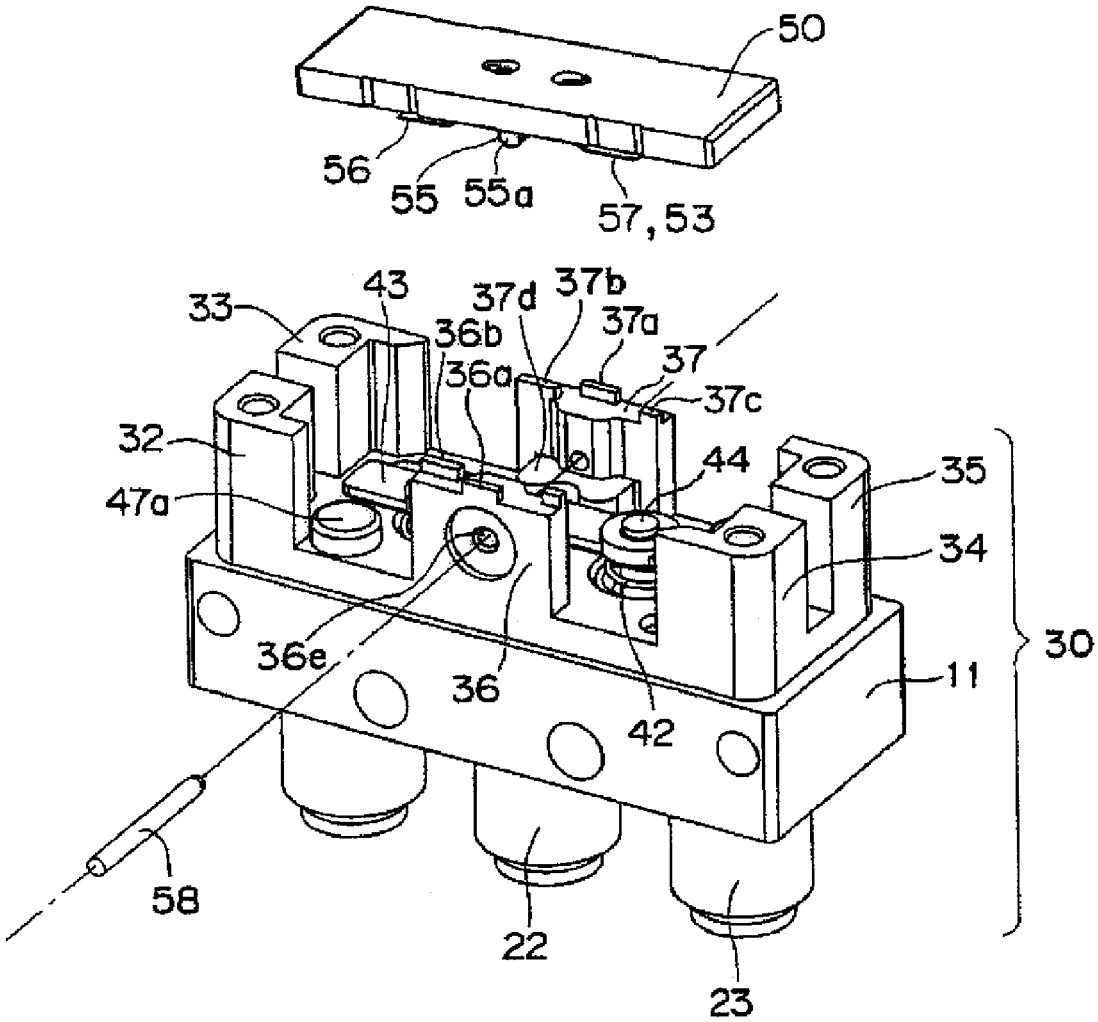
FIG. 12 is a perspective view for describing a method for assembling the movable iron piece to the contact point unit.

Then, as shown in FIG. 12, by placing the movable iron piece 50 between the supporting walls 36, 37 of the contact point base 31, and inserting the supporting shaft 58 into the shaft holes 36*e*, 37*e* of the supporting walls 36, 37 and the shaft hole 55*a* of the movable iron piece 50, the movable iron piece 50 is supported so as to be rotatable.

Next, as shown in FIG. 13, the first iron core 76 is positioned with respect to the upper surfaces 32, 33 of the contact point base 31 through a shielding plate 48, and fixed with the screws 78*a*, 78*b*. Similarly, the second iron core 78 is positioned with respect to the upper surfaces 34, 35 of the contact point base 31, and fixed with the screws 78*c*, 78*d*. Positioning of the first and second iron cores 76, 77 may be performed with jigs not shown. Further, if required, the shielding plate may be placed on both sides of the contact point base 31.

On the other hand, as shown in FIG. 14A, after inserting the coil terminals 72*a*, 72*b* into the flange portion 62 of the first spool 61 from a lateral side, the leader line of the coil 71 wound on the body portion 61*a* is tied to the protruding horizontal end portions of the coil terminals 72*a*, 72, and then soldered. Similarly, as shown in FIG. 14B, after inserting the coil terminals 74*a*, 74*b* into the flange portion 66 of the second flange 65 from a lateral side, the leader line of the coil 73 wound on the body portion 65*a* is tied to the protruding horizontal end portions of the coil terminals 74*a*, 74*b*, and then soldered.

Figure 15:
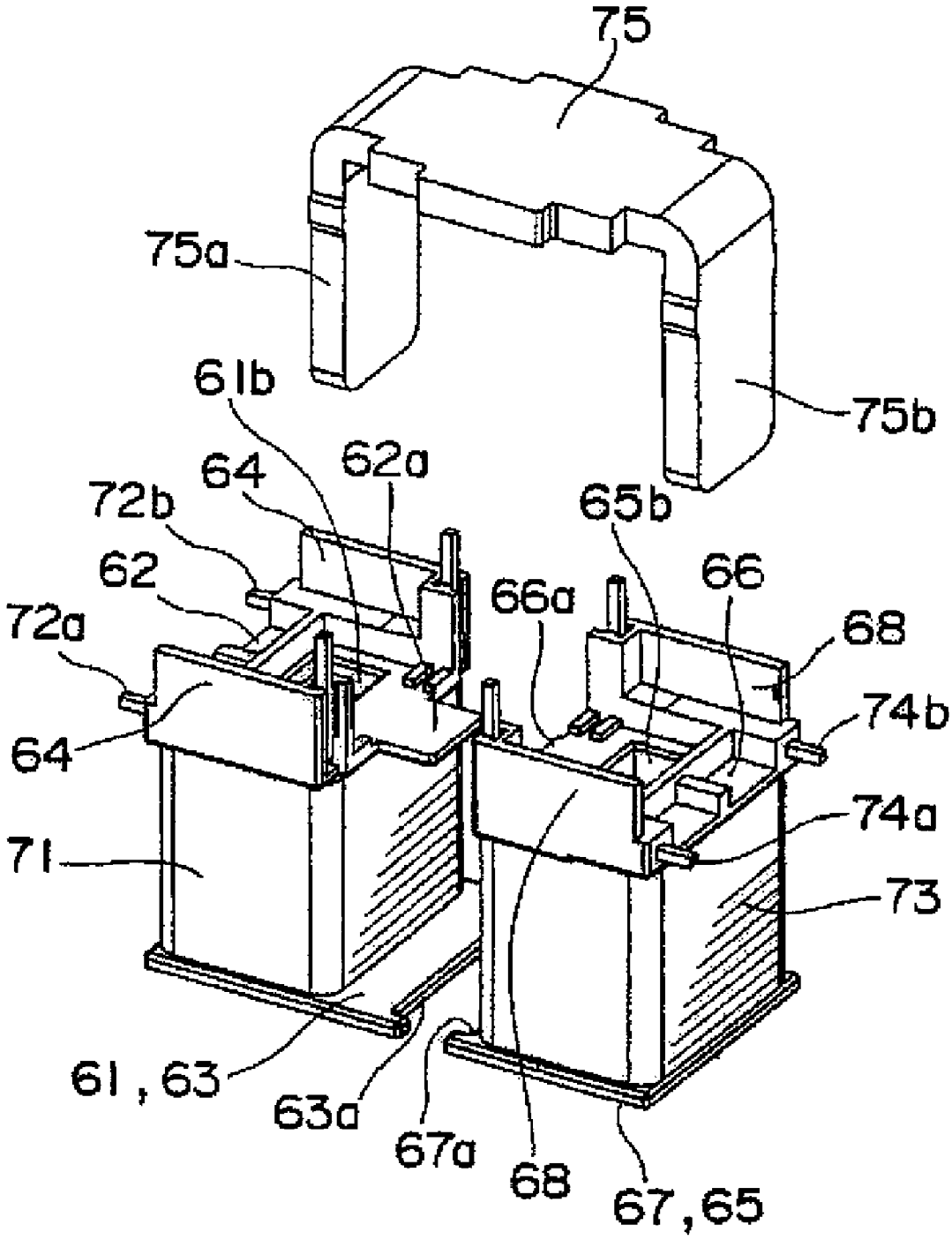
FIG. 15 is a perspective view for describing a method for assembling a yoke to the first and second spools.
Figure 16:
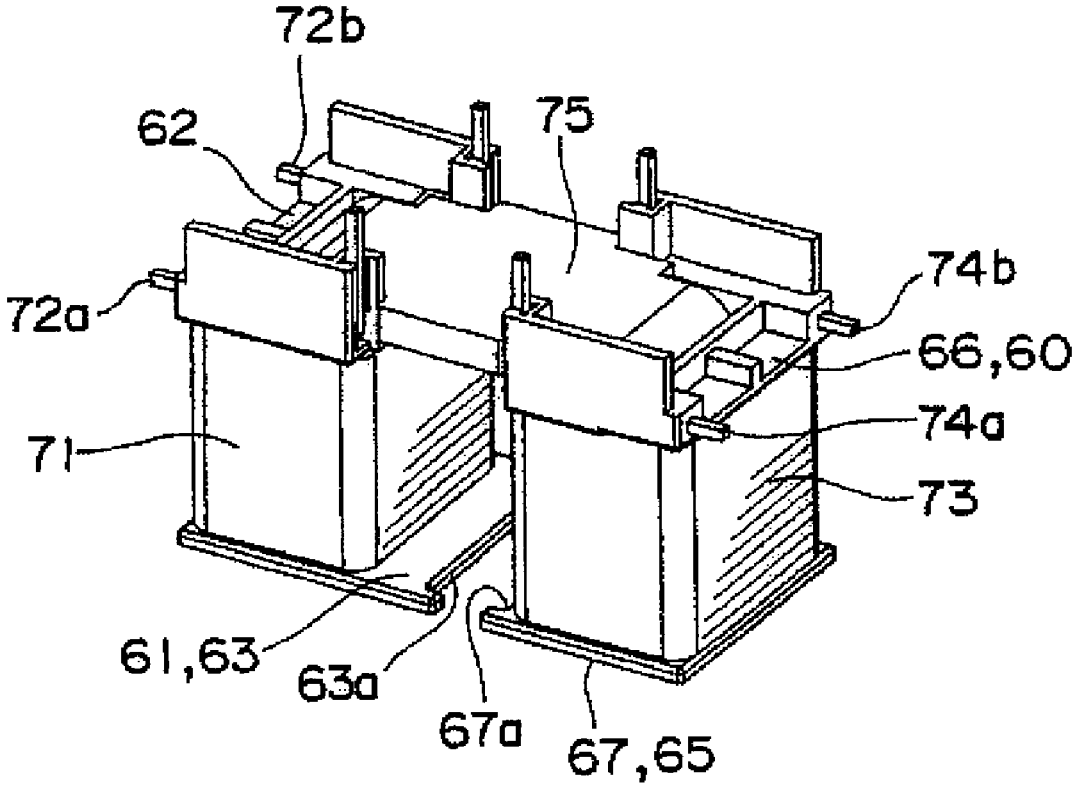
FIG. 16 is a perspective view for describing a method for assembling a permanent magnet to the first and second spools.
Figure 16:
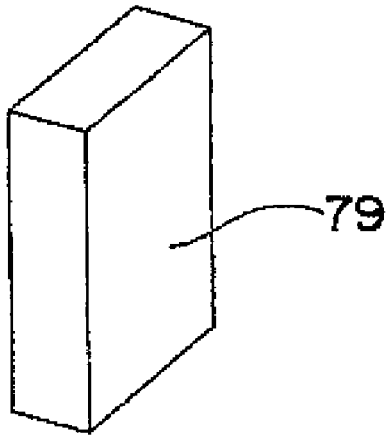

Thereafter, as shown in FIG. 15, the first and second spools 61, 65 are positioned. Then, the arm portions 75*a*, 75*b* of the yoke 75 are press-fitted into the through holes 61*b*, 65*b* of the cylindrical body portions 61*a*, 65*a*, respectively, so that they are integrated. After that, as shown in FIG. 16, the permanent magnet 79 is inserted between the positioning tongues 62*a*, 66*a* of the first and second spools 61, 65 as well as between the notch portions 63*a*, 67*a* of the flange portions 63, 67, whereby an upper end surface of the permanent magnet 79 is attracted to a lower surface of the yoke 75.

Figure 2:
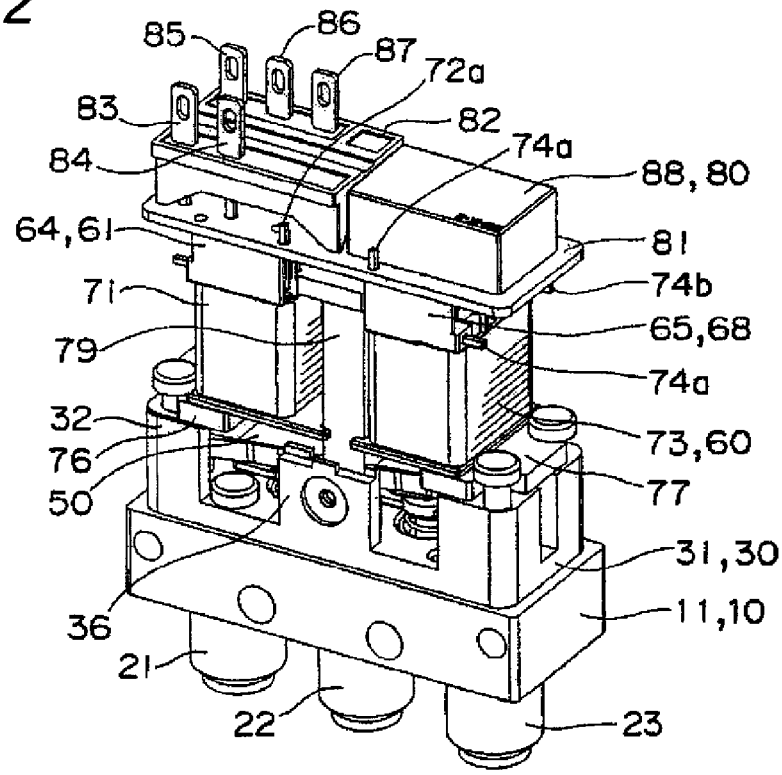
FIG. 2 is a perspective view showing a state in which a cover is removed from the coaxial relay shown in FIG. 1.
Figure 3:
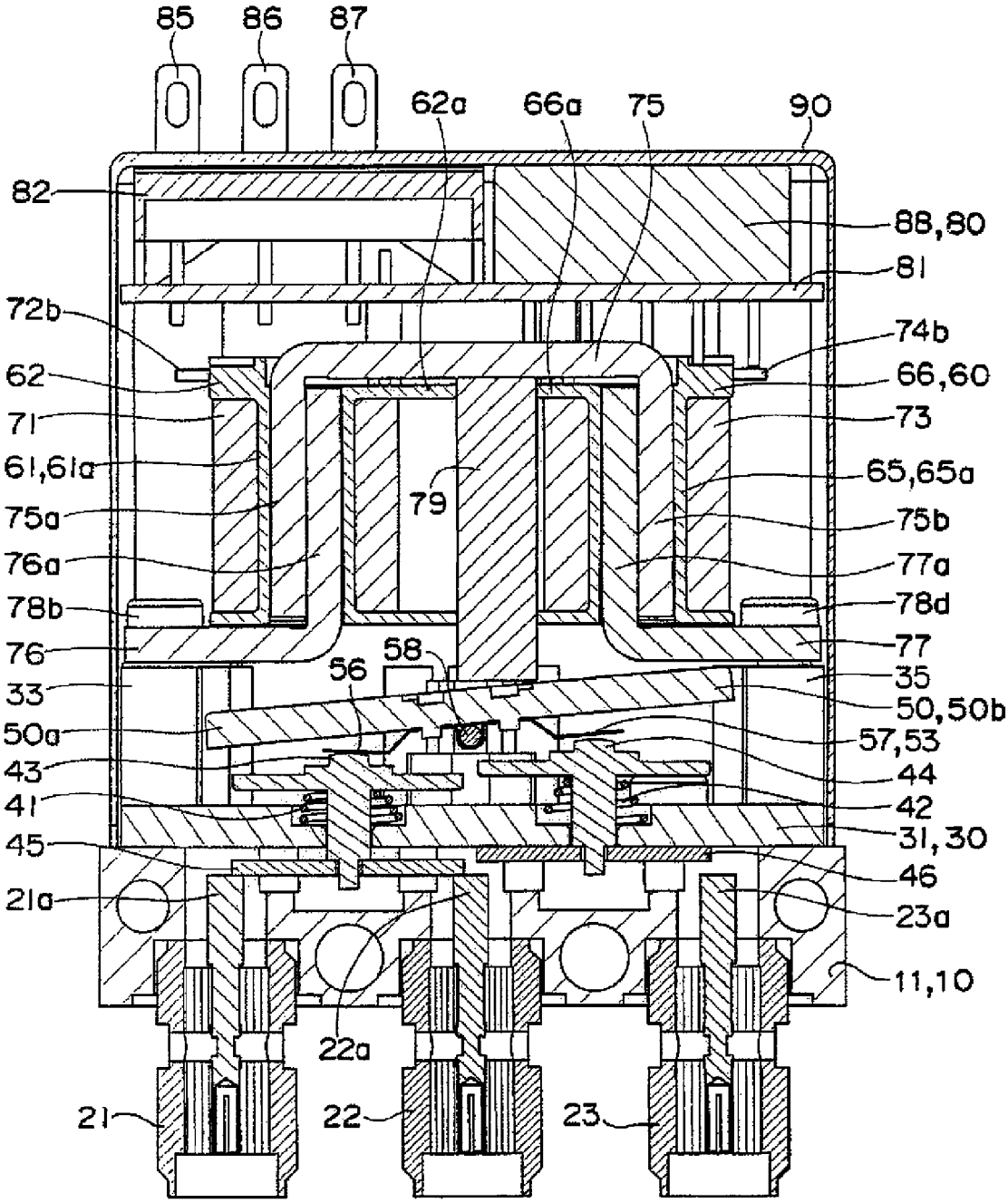
FIG. 3 is a cross sectional view of the coaxial relay shown in FIG. 1 before its operation.
Figure 4:
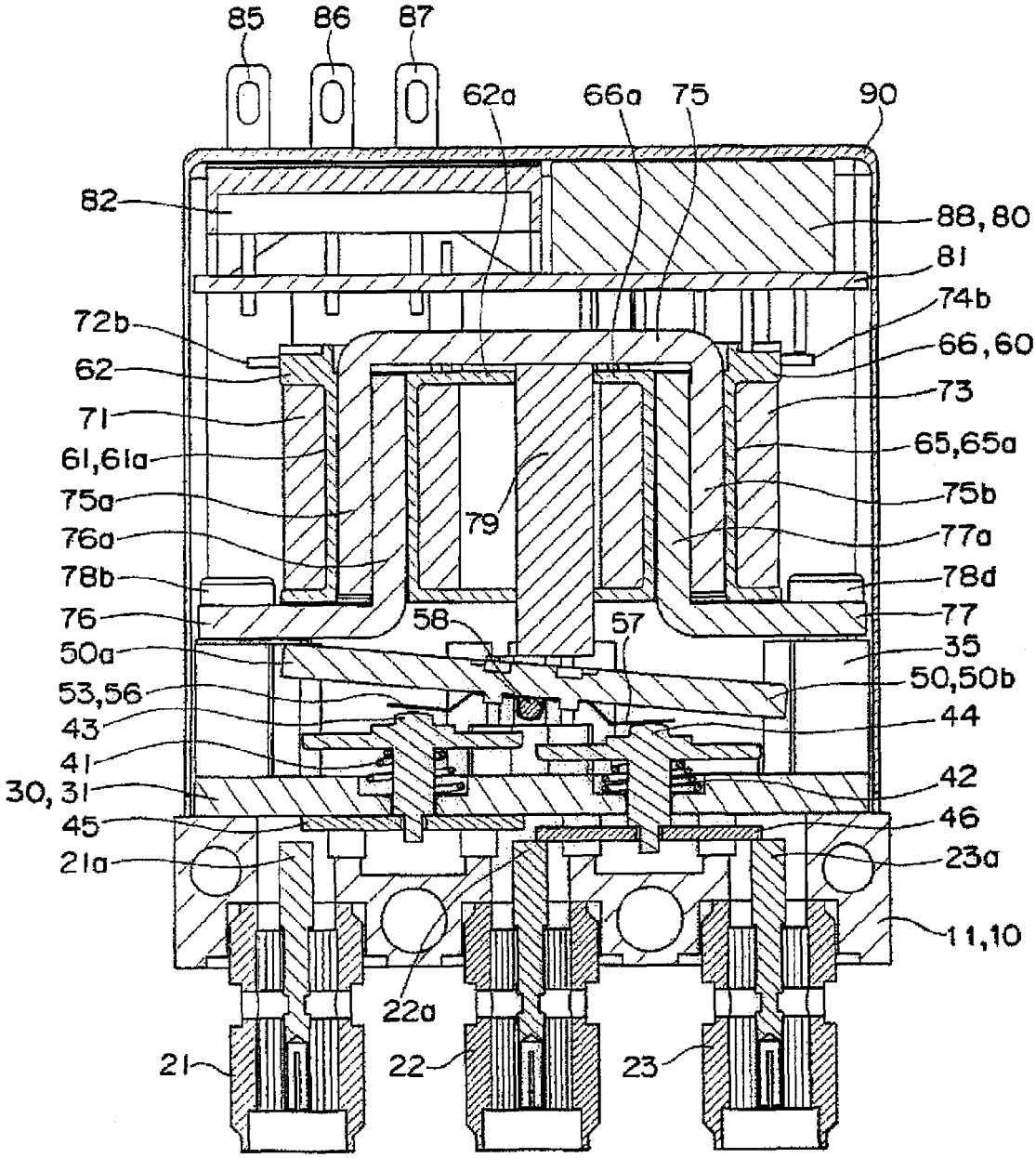
FIG. 4 is a cross sectional view of the coaxial relay shown in FIG. 1 after its operation.
Figure 5:
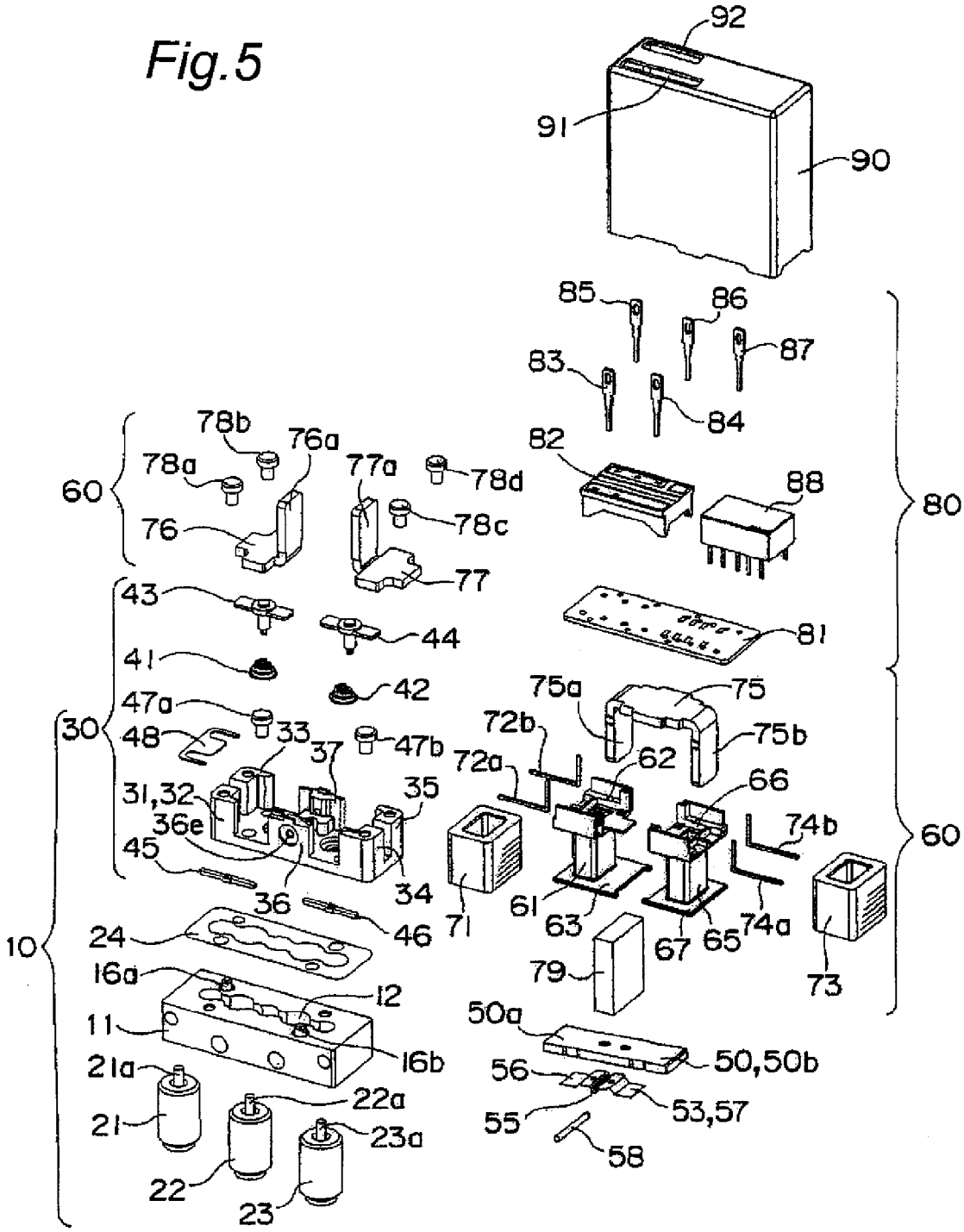
FIG. 5 is an exploded perspective view of the coaxial relay shown in FIG. 1.
Figure 17:
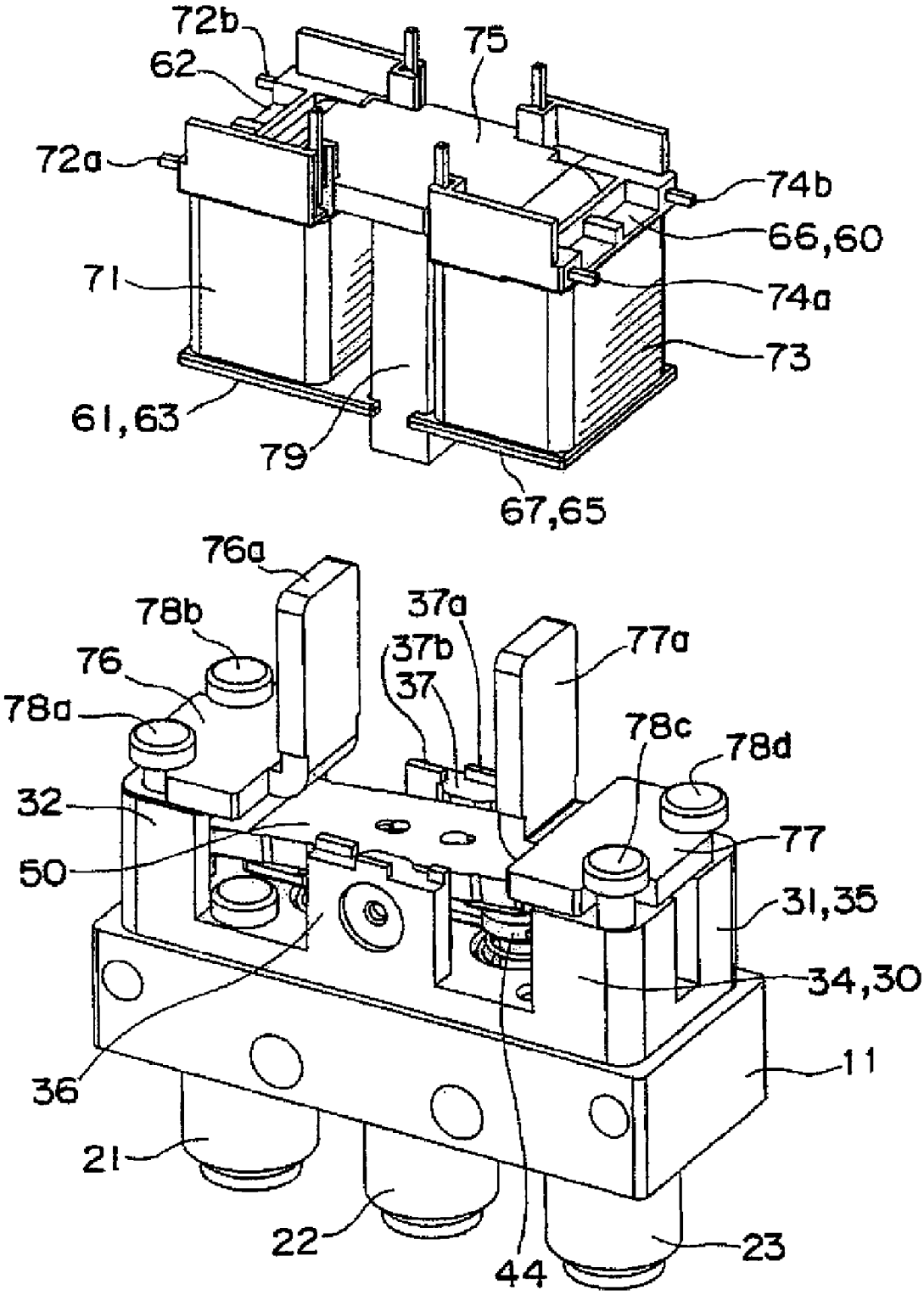
FIG. 17 is a perspective view for describing a method for assembling an electromagnetic unit to the contact point unit.

Furthermore, as shown in FIG. 17, the vertical portions 76*a*, 77*b* of the first and second iron cores 76, 77 assembled to the contact point unit 10 are inserted into the through holes 61*b*, 65*b* of the cylindrical body portions 61*a*, 65*b* of the first, second spools 61, 65, respectively, whereby the arm portions 75*a*, 75*b* of the yoke 75 and the vertical portions 76*a*, 77*b* of the first and second spools are brought into surface contact with each other (see FIGS. 2 and 3). Therefore, the movable iron piece 50 is attracted to a lower end surface of the permanent magnet 79 in a manner so as to be rotatable. Then, a seal material is injected into the through holes 61*b*, 65*b* to be solidified, whereby the arm portions 75*a*, 75*b* and the vertical portions 76*a*, 77*a* are joined to be integrated, so that the electromagnetic block 60 is fixed to the contact point unit 10.

According to the present embodiment, since the movable iron piece 50 is attracted to the lower end surface of the permanent magnet 79 so as to be rotatable, and the elastic arm portions 56, 57 of the plate spring 53 urge the plungers 43, 44 downward, the movable iron piece 50 is in a state of being pressed upward. On the other hand, the supporting shaft 58 is inserted into the shaft holes 36*e*, 37*e* of the supporting walls 36, 37 to be supported. Therefore, the supporting shaft 58 does not come in contact with the movable iron piece 50, and a lower surface of the supporting shaft 58 is always in line contact with an inner peripheral surface of the bearing portion 55. Using the contact portion as a fulcrum, the movable iron piece 50 is supported so as to be rotatable. As a result, since the plate spring 53 is brought into line contact with the supporting shaft 58, there is an advantage that a relay which has a small friction, a long lifetime and good operation characteristics with less movement of the rotation shaft center is obtained.

Further, according to the present embodiment, since the contact point base 31, which has the shaft holes 36*e*, 37*e*, and whose upper and lower surfaces serve as reference surfaces, is held by the base block 11 and the electromagnetic block 60, there is an advantage that high assembling accuracy can be secured and that a relay having excellent operation characteristics is obtained.

By bending the arm portions 56, 57 of the plate spring 53 from gaps between the supporting posts 32, 33, 34, 35 and the supporting walls 36, 37 of the contact point base 31, adjustment of the operation characteristics is performed.

Therefore, according to the present embodiment, since the adjustment of the operation characteristics can be performed by bending the elastic arm portions 56, 57 of the plate spring 53 from the gaps, there is an advantage that a relay with high operability and a high manufacturing yield is obtained.

Thereafter, the printed circuit board 81 on which the terminal stand 82 and the electronic component 88 are mounted is placed on the positioning walls 64, 68 of the flange portions 62, 66, and electrically connected to vertical upper end portions of the coil terminals 72*a*, 72*b* and 74*a*, 74*b* of the electromagnetic unit 80, so that they are integrated.

By fitting the cover 90 over the contact point unit on which the electromagnetic unit 60 is mounted, the input/output terminals 83 to 88 are protruded from the elongate openings 91, 92. Then, the seal material is injected into notch portions provided in opening edge portions of the cover 90 to be solidified, thus sealing the notch portions.

Next, operation of the coaxial relay will be described.

First, as shown in FIG. 3, if a voltage is not applied to the coils 71, 73, since the permanent magnet 79 is not located at the center, and the magnetic balance is disturbed by placing the shielding plate 48 on one side, the other end portion 50*b* of the movable iron piece 50 is attracted to the second iron core 77. Therefore, the elastic arm portion 56 of the plate spring 53 presses the plunger 43 downward against a spring force of the coil spring 41. As a result, both end portions of the movable contact point 45 are respectively brought into press contact with the fixed contact points 21*a*, 22*a* respectively to close an electrical circuit.

Then, if a voltage is applied to the coils 71, 73 so that one end portion 50*a* of the movable iron piece 50 is attracted, the other end portion 50*b* of the movable iron piece 50 repulses the second iron core 77, and said one end portion 50*a* is attracted to the first iron core 76. Therefore, the movable iron piece 50 is rotated using as a fulcrum a portion where a lower end surface of the supporting shaft 58 assembled to the movable iron piece 50 and an inner peripheral surface of the shaft hole 55 are brought into line contact with each other. As a result, after the elastic arm portion 56 of the plate spring 53 has separated from the plunger 43, the elastic arm portion 57 presses down the plunger 44 against a spring force of the coil spring 42. Therefore, after both of the end portions of the movable contact point 45 have separated from the fixed contact points 21*a*, 22*a*, both end portions of the movable contact point 46 are attracted to the fixed contact points 22*a*, 23*a*.

If a voltage applied to the coils 71, 73 is disconnected, the right and left magnetic balance of the movable iron piece 50 is disrupted, so that the resultant force of the coil spring 42 and the plate spring 53 becomes relatively larger than the magnetic force of the permanent magnet 79. Therefore, the other end portion 50*b* of the movable iron piece 50 is attracted to the second iron core 77, and the movable iron piece 50 is rotated using the lower end surface of the supporting shaft 58 as a fulcrum. As a result, the elastic arm portion 57 of the plate spring 53 is separated from the plunger 44, and the elastic arm portion 56 presses down the plunger 43. Then, after both of the end portions of the movable contact point 46 have separated from the fixed contact points 22*a*, 23*a*, both of the end portions of the movable contact point 45 are brought into press contact with the fixed contact points 21*a*, 22*a* so as to recover to the original state.

Although the self-resetting type relay was described in the present embodiment, for example, using a pair of self-holding type spools 69 as shown in FIG. 10E and FIG. 10F, the permanent magnet 79 is held at the center to construct the self-holding type relay.

The coaxial relay of the present invention is not limited to the above mentioned embodiment, and it can be applied to other relays.

The invention claimed is:

1. A relay comprising:

a contact point block comprising:

a support shaft with both ends spanning supporting walls integrally molded with both side edge portions, opposite to each other, of an upper surface of a contact point base;

a plunger having a movable contact at a lower end thereof;

a movable iron piece configured to drive the plunger and to have a plate spring fixed at a lower surface thereof;

an electromagnetic unit that directly fixes an iron core to upper end faces of a plurality of supporting posts projected at the corners of the upper surface of the contact point base;

a base block having a fixed contact point at a position opposite to the movable contact point so as to be able to be contacted with and separated from the movable contact point, wherein the plunger is alternately attracted to and separated from the iron core of the electromagnetic unit based on excitation and nonexcitation of the electromagnetic unit such that the movable contact point is contacted with and separated from the fixed contact point, wherein the movable iron piece is supported on the supporting shaft so as to be rotatable, wherein the plunger is inserted through an operation hole of the contact point base so as to be movable up and down, wherein the plunger has the movable contact point at a lower end portion protruding from a lower surface of the contact point base, wherein upper and lower surfaces of the contact point block are held by the electromagnetic unit and the base block, and wherein the lower surface of the contact point base constituting the contact point block and the upper faces of the plurality of supporting posts are respectively sandwiched between the base block and the electromagnetic unit.

2. The relay according to claim 1, wherein the contact point base has at least one adjustment opening, which enables an adjustment of the plate spring from a lateral side thereof.

3. The relay according to claim 1, further comprising a magnetic shielding sheet held by the base block and the contact point block.

4. The relay according to claim 2, further comprising a magnetic shielding sheet held by the base block and the contact point block.

* * * * *